US007911304B2

(12) United States Patent
Yano et al.

(10) Patent No.: US 7,911,304 B2
(45) Date of Patent: Mar. 22, 2011

(54) ELECTROMAGNETIC RELAY

(75) Inventors: Keisuke Yano, Kyoto (JP); Masayuki Noda, Kyoto (JP); Hiroshi Ono, Kyoto (JP); Hiroyuki Fujita, Kyoto (JP)

(73) Assignee: OMRON Corporation, Kyoto (JP)

( * ) Notice: Subject to any disclaimer, the term of this patent is extended or adjusted under 35 U.S.C. 154(b) by 305 days.

(21) Appl. No.: 12/297,647

(22) PCT Filed: May 11, 2007

(86) PCT No.: PCT/JP2007/059748

§ 371 (c)(1),
(2), (4) Date: Oct. 20, 2008

(87) PCT Pub. No.: WO2007/132773

PCT Pub. Date: Nov. 22, 2007

(65) Prior Publication Data

US 2009/0237191 A1 Sep. 24, 2009

(30) Foreign Application Priority Data

May 12, 2006 (JP) ..... 2006-133871

(51) Int. Cl.
*H01H 9/30* (2006.01)
*H01H 33/18* (2006.01)

(52) U.S. Cl. ..... 335/201; 335/131; 335/132; 335/179; 335/229

(58) Field of Classification Search ..... 335/132, 335/201, 131, 179, 229–234
See application file for complete search history.

(56) References Cited

U.S. PATENT DOCUMENTS 5,546,061 A * 8/1996 Okabayashi et al. ..... 335/78
5,892,194 A * 4/1999 Uotome et al. ..... 218/68
7,157,997 B2 * 1/2007 Ohkubo et al. ..... 335/201

FOREIGN PATENT DOCUMENTS

GB 2058463 A * 4/1981
JP 37-16049 Y1 7/1962
JP 7-235248 A 9/1995
JP 9-204866 A 8/1997
JP 2001-176370 A 6/2001

OTHER PUBLICATIONS

International Search Report w/translation from PCT/JP2007/059748 dated Jul. 10, 2007 (2 pages).
Patent Abstracts of Japan; Publication No. 09-204866 dated Aug. 5, 1997; Fuji Electric Co., Ltd. (1 page).
Patent Abstracts of Japan; Publication No. 07-235248 dated Sep. 5, 1995; Nippondenso Co., Ltd. (1 page).
Patent Abstracts of Japan; Publication No. 2001-176370 dated Jun. 29, 2001; Denso Corp. (9 pages).

* cited by examiner

*Primary Examiner* — Ramon M Barrera
(74) *Attorney, Agent, or Firm* — Osha • Liang LLP

(57) ABSTRACT

An electromagnetic relay has a movable iron core, an insulation holder integrated with an upper end portion of the movable iron core, a movable contact piece supported by the insulation holder, and a solenoid formed from a wound coil. The movable iron core is housed in an axial hole in the solenoid movably in the upward and downward directions. The movable iron core is adapted to be moved upwardly and downwardly based on magnetization and demagnetization of the solenoid for contacting and separating a movable contact point provided on the movable contact piece with and from a fixed contact point for opening and closing a contact point. A permanent magnet is embedded in a base portion of the insulation holder.

2 Claims, 19 Drawing Sheets

ELECTROMAGNETIC RELAY

TECHNICAL FIELD

The present invention relates to an electromagnetic relay and, more particularly, to an electromagnetic relay including erasure means for erasing the arc generated at the time of opening and closing of contact points.

BACKGROUND ART

Conventionally, as electromagnetic relays including arc erasure means, there have been electromagnetic relays provided with permanent magnets as erasure means.

That is, these electromagnetic relays have a solenoid portion 1 having a coil 13 wound around a bobbin 12 which is housed coaxially within a yoke 11 with a cylindrical shape with a ceiling and, further, have a plunger 17 which is reciprocated upwardly and downwardly for opening and closing a contact point (e.g., refer to Patent Document 1). In the electromagnetic relays, in order to erase the generated arc, as illustrated in FIG. 2 in Patent Document 1, two pairs of permanent magnets 7, each pair having two permanent magnets, are placed in parallel, with movable contact-point carrying members 4 and 6 sandwiched therebetween.

Patent Document 1: JP-A No. 2001-176370

SUMMARY OF THE INVENTION

However, the aforementioned electromagnetic relays require a plurality of permanent magnets 7, which involves a larger number of components and a larger number of assembling processes and, also, requires a larger housing space, and small-sized electromagnetic relays with smaller bottom areas can not be provided.

One or more embodiments of the present invention provides a small-sized electromagnetic relay with a small bottom area which requires a small number of components and a small number of assembling processes.

An electromagnetic relay according to one or more embodiments of the present invention is an electromagnetic relay including a movable iron core, an insulation holder integrated with the upper end portion of the movable iron core, a movable contact piece supported by the insulation holder, and a solenoid formed from a wound coil, the movable iron core being housed in an axial hole in the solenoid movably in the upward and downward directions, and the movable iron core being adapted to be moved upwardly and downwardly based on the magnetization and demagnetization of the solenoid for contacting and separating a movable contact point provided on the movable contact piece with and from a fixed contact point for opening and closing a contact point, wherein a permanent magnet is embedded in a base portion of the insulation holder.

With one or more embodiments of the present invention, it is possible to lead the arc generated at the time of opening and closing the contact point through the magnetic force of the single permanent magnet embedded in the base portion of the insulation holder, thereby erasing the arc. This enables provision of an electromagnetic relay with a small bottom area which requires a small number of components and a small number of assembling processes and can save the space for housing the permanent magnet.

In an embodiment according to the present invention, the insulation holder can be formed integrally with a pull-out preventing concave and convex portion formed at the upper end portion of the movable iron core.

With the present embodiment, it is possible to provide an electromagnetic relay with excellent durability which can prevent the disengagement of the insulation holder with the pull-out preventing concave and convex portion.

In another embodiment according to the present invention, an arc-erasing ceramic member can be placed at least at a portion of the inner side surface of a housing which houses the fixed contact point and the movable contact point and also shields the arc generated at the time of opening and closing of the contact point.

With the present embodiment, the ceramic member depletes heat of the arc, which can effectively erase the arc and also can protect the housing from the heat of the arc, thereby offering the advantage of provision of an electromagnetic relay with an increased life.

EXPLANATION OF SYMBOLS

Figure 1:
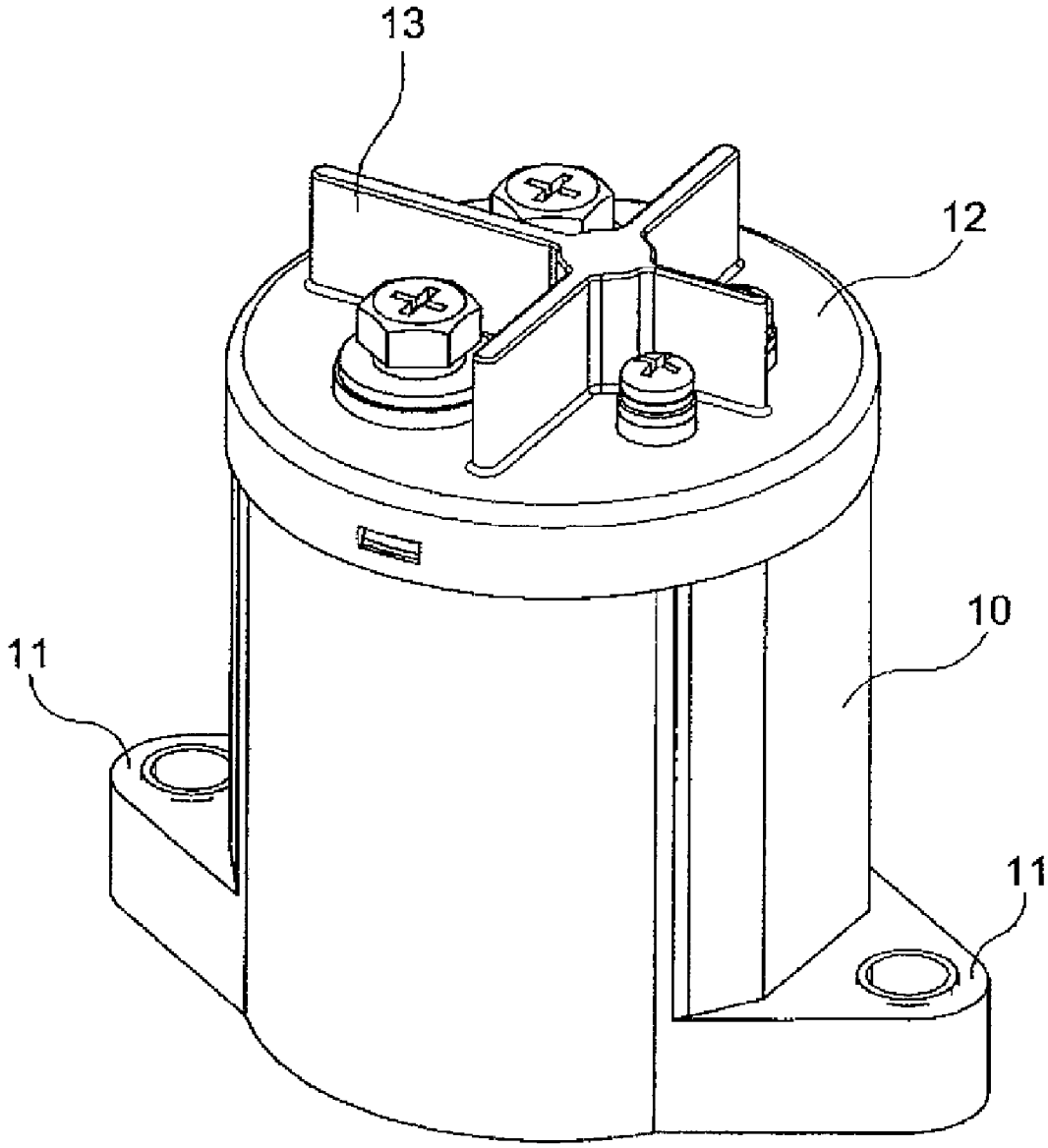
FIG. 1 is a perspective view illustrating a first embodiment of an electromagnetic relay according to the present invention.

10: Resin case
12: Resin cap
13: Insulation wall
20: Electromagnetic-relay main body
21: Metal case
22: Metal cover
23: Concave portion
26: Gas venting hole
27: Gas venting pipe
30: Electromagnet unit
31: Spool
32; Winding body portion
32*a*: Axial hole
33, 34: Collar portion
35: Coil
36, 37: Pedestal portion
38, 39: Relay terminal
38*b*, 39*b*: Connection portion
40: Yoke
41: Side opening portion
43: Through hole
44: Cutout portion
45: Restoring spring
46; Fixed iron core
47: Mortar-shaped concave portion
50: Contact-point mechanism unit
51: First base
51*b*: Adjustment hole
52: Second base
53, 54: Plate-shaped permanent magnet
55, 56: Fixed contact-point terminal
55*a*, 56*a*: Fixed contact point
57: Permanent magnet
60: Movable contact-point block
61: Movable iron core
62: Insulation annular holder
63: Contact pressing spring
64: Movable contact piece
65, 66: Movable contact point
70: Secondary yoke
71: Tongue piece
72: Annular rib
73: Through hole
81, 82; Coil terminal
81*a*, 82*a*: Connection portion
83: Insulation cover
86. Gas venting hole
87: Protruding piece
90: Center hole
91: Box-shaped base table
92: Jig pin
95, 98: Probe
100: Operational-characteristic adjustment device
101: Control unit
102: Measurement/stroke control unit
103. Iron core fixing unit
104: Characteristic measurement machine
105: Data processing device
110: Dust

DETAILED DESCRIPTION

Embodiments of the present invention will be described with reference to the accompanying drawings in FIGS. 1 to 19.

According to a first embodiment, as illustrated in FIGS. 1 to 17, there is provided an electromagnetic relay including a resin case 10 with a pair of mounting flange portions 11, an electromagnetic-relay main body 20 which is housed in the resin case 10, and a resin cap 12 fitted to the resin case 10 and then sealed. On the upper surface of the cap 12, there is a substantially-cross-shaped insulation wall 13 protruded therefrom.

Figure 3:
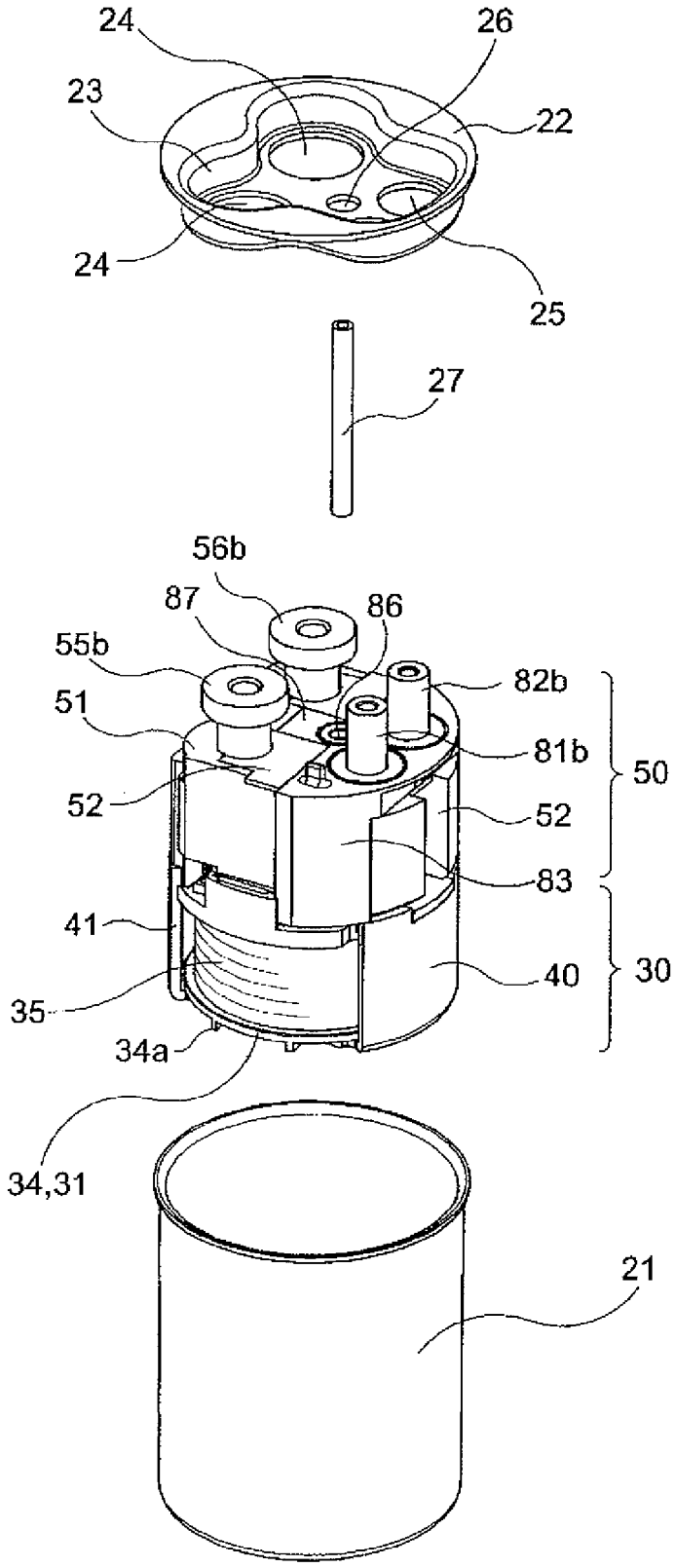
FIG. 3 is an exploded perspective view of the electromagnetic-relay main body illustrated in FIG. 2.

As illustrated in FIG. 3, the electromagnetic-relay main body 20 houses an electromagnet unit 30 and a contact-point mechanism unit 50 which are integrated with each other, in a space sealed by a metal case 21 having a cylindrical shape with a bottom and a metal cover 22 which are integrated with each other through welding. The metal cover 22 is made of, for example, Al, Cu, Fe or SUS and is provided with a concave portion 23 formed through presswork and terminal holes 24 and 25 and a gas venting hole 26 provided through the bottom surface of the concave portion 23. Particularly, in the present embodiment, the concave portion 23 is placed, such that the shortest distances from the outer peripheral surfaces of terminal portions 55*b*, 56*b*, 81*b* and 82*b* which will be described later to the edge portion of the concave portion 23 are substantially equal to one another. This can offer the advantage of alleviation of the concentration of stresses due to thermal stresses on the sealing material for preventing the separation and the like of the sealing material and, also, can offer the advantage of reduction of the amount of the used sealing material.

Figure 5:
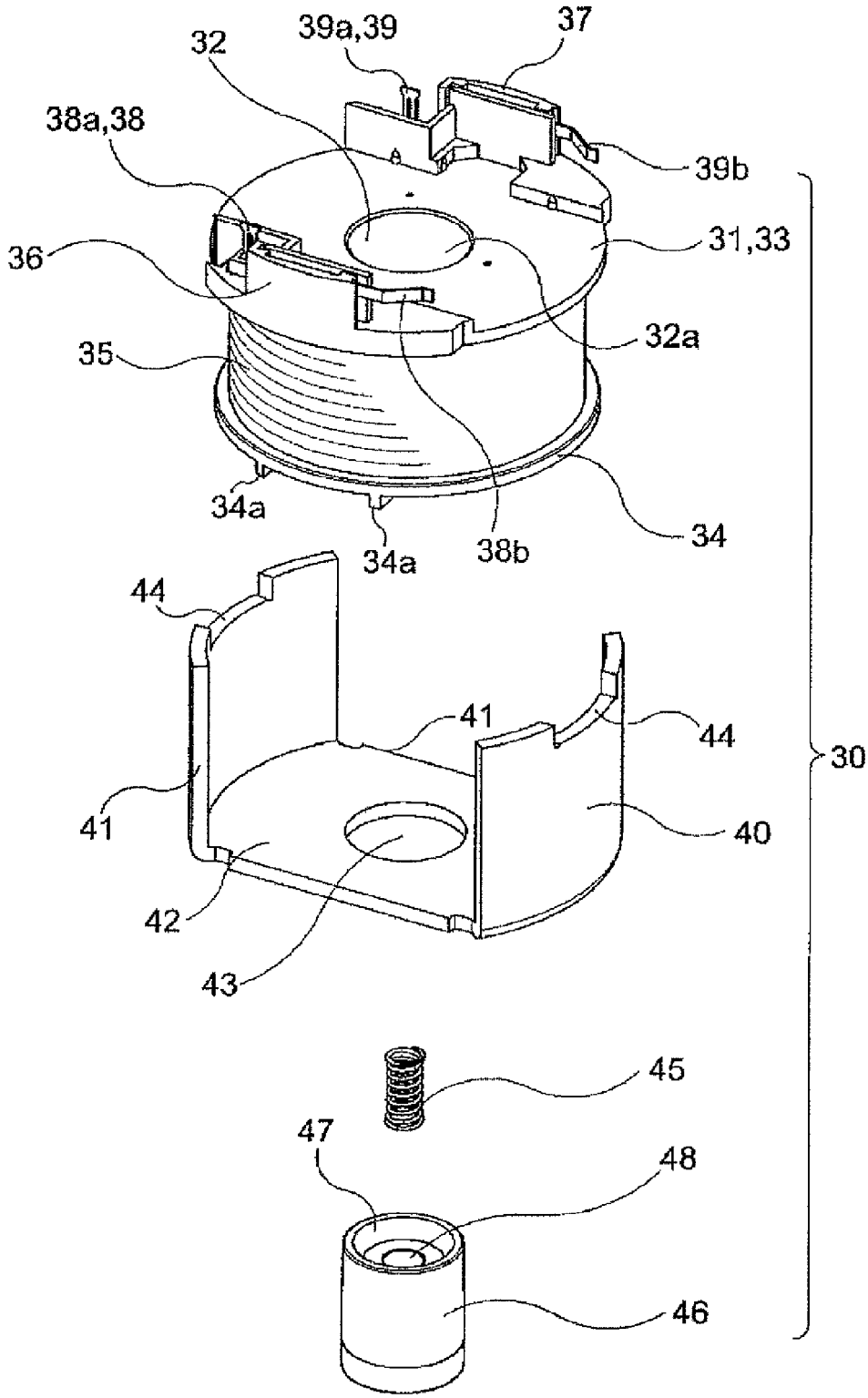
FIG. 5 is an exploded perspective view of the electromagnet unit illustrated in FIG. 4.

As illustrated in FIG. 5, the electromagnet unit 30 is constituted by a spool 31 having collar portions 33 and 34 at its upper and lower portions, a coil 35 wound around a winding body portion 32 of the spool 31, and a yoke 40 assembled with the spool 31. The winding body portion 32 is formed to have an elliptical cross-sectional area for increasing the number of windings of the coil 35. Further, relay-terminal pedestal portions 36 and 37 are protruded from edge portions of the upper surface of the upper collar portion 33 at its opposite sides, such that they are faced to each other. Relay terminals 38 and 39 to be connected to coil terminals 81 and 82 which will be described later are press-fitted in press-fitting slots in the pedestal portions 36 and 37. Accordingly, binding portions 38*a* and 39*a* and connection portions 38*b* and 39*b* of the relay terminals 38 and 39 are protruded from the pedestal portions 36 and 37. Further, on the bottom surface of the lower collar portion 34, there are a pair of positioning ribs 34*a* with a substantially U shape protruded therefrom, for positioning the yoke 40 which will be described later. Further, after the coil 35 is wound around the winding body portion 32 of the spool 31, the leader lines of the coil 35 are bound and soldered to the binding portions 38*a* and 39*a* of the relay terminals 38 and 39. Accordingly, the solenoid formed from the coil 35 has a substantially-elliptical cross-sectional area.

The yoke 40 is formed from a magnetic material having a cylindrical shape with a bottom and is shaped to have side opening portions 41 and 41 formed by cutting away opposing side portions of the side walls. Further, at the center portion of the bottom surface 42 of the yoke 40, there is provided a through hole 43 which allows a fixed iron core 46 which will be described later to be press-fitted therein. Further, the yoke 40 is provided, at edge portions of its upper side at the opposite sides, with cutout portions 44 and 44 for securing a plate-shaped secondary yoke 70 which will be described later.

The fixed iron core 46 has a cylindrical shape which can be press-fitted in the through hole 43 in the yoke 40 and, also, is provided, in its upper end surface, with a mortar-shaped concave portion 47 which can be fitted to the lower end portion of a movable iron core 61 which will be described later. Further, in the bottom surface of the mortar-shaped concave portion 47, there is provided a housing hole 48 which can house a restoring spring 45 therein.

Figure 4:
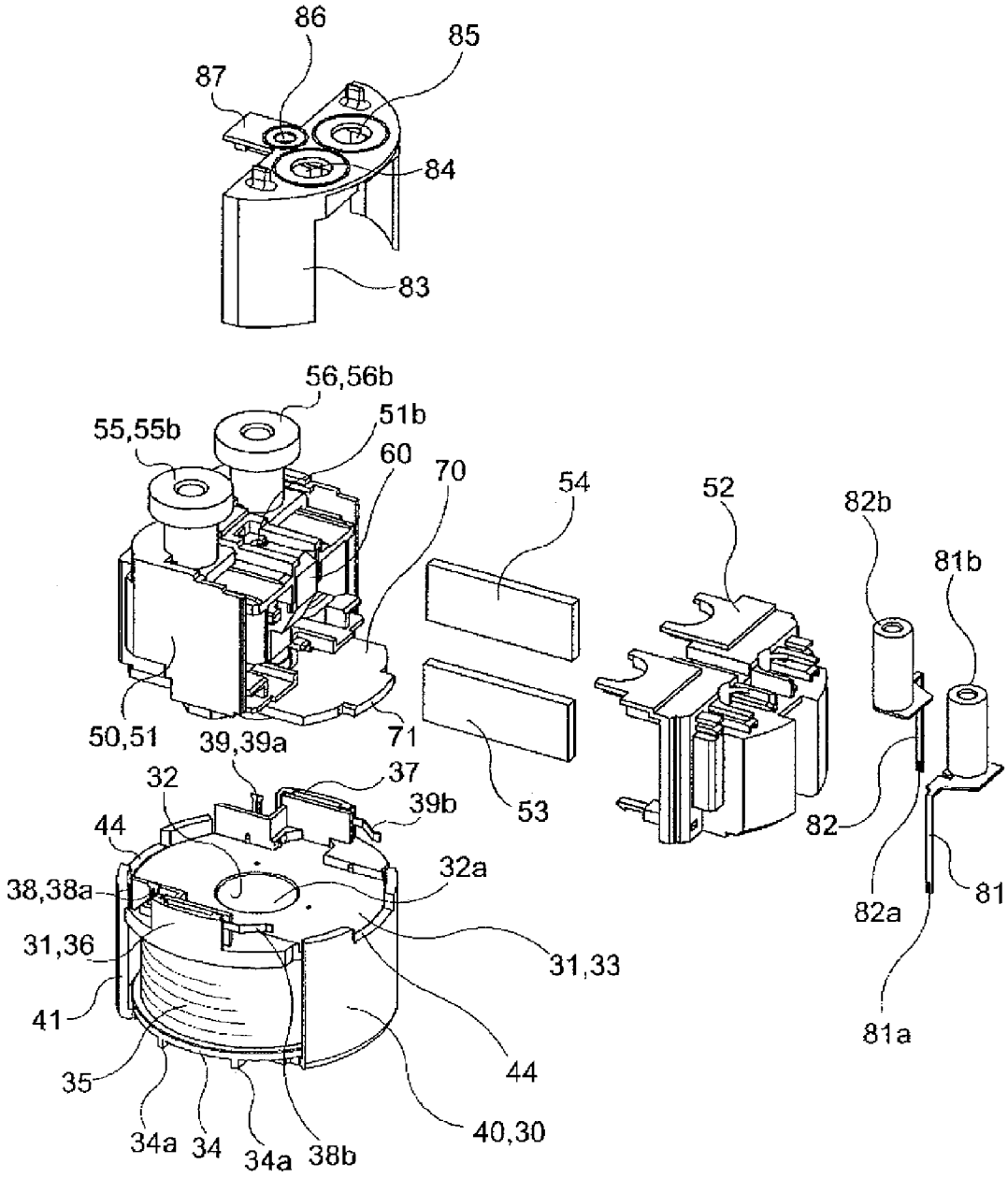
FIG. 4 is an exploded perspective view of an electromagnet unit and a contact-point mechanism unit illustrated in FIG. 3.

As illustrated in FIG. 4, the contact-point mechanism unit 50 is constituted by two plate-shaped permanent magnets 53 and 54, a pair of fixed contact-point terminals 55 and 56, and a movable contact-point block 60, which are assembled with one another, in an internal space defined by a first base 51 and a second base 52 assembled with each other. Further, a plate-shaped secondary yoke 70 is secured, through caulking, to the bottom surface of the first base 51. Further, a pair of coil terminals 81 and 82 and an insulation cover 83 are assembled with the outer side surface of the second base 52.

Figure 6:
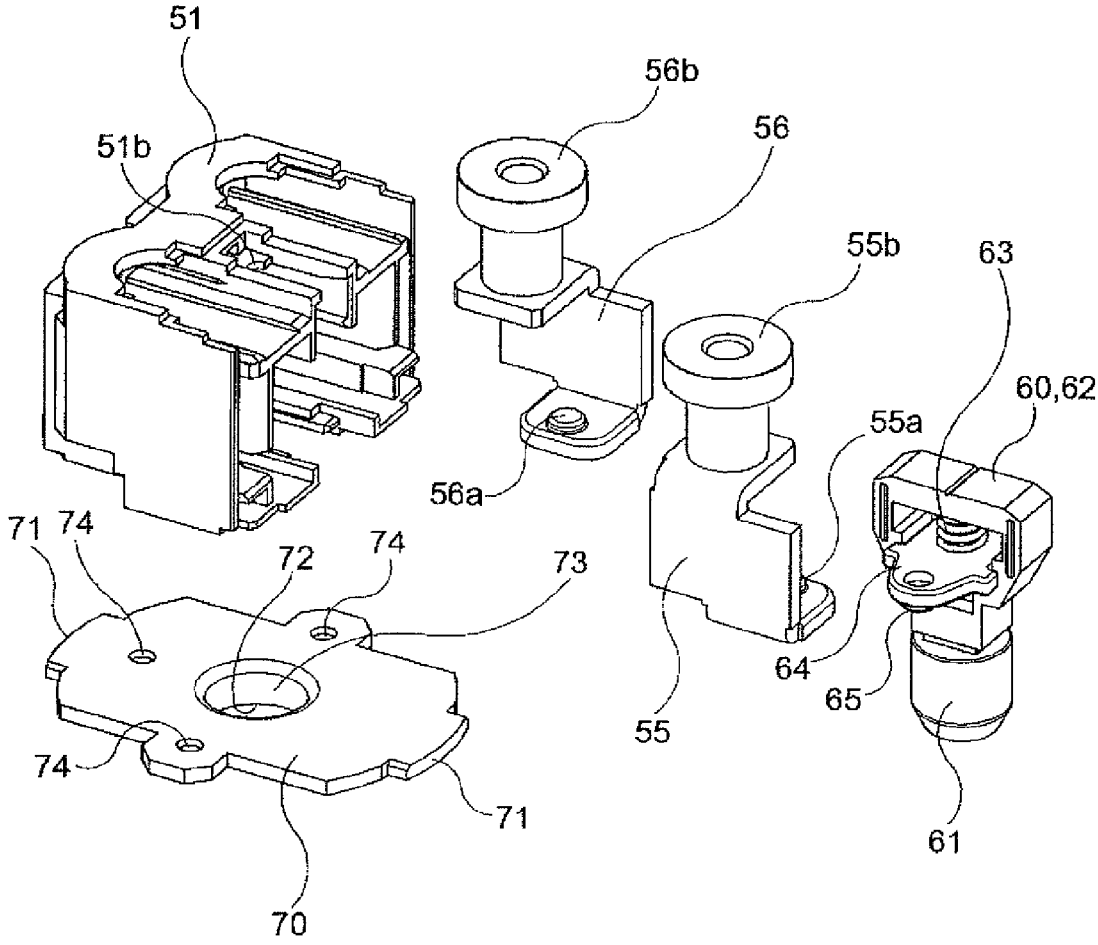
FIG. 6 is an exploded perspective view of the contact-point mechanism unit illustrated in FIG. 4.
Figure 7:
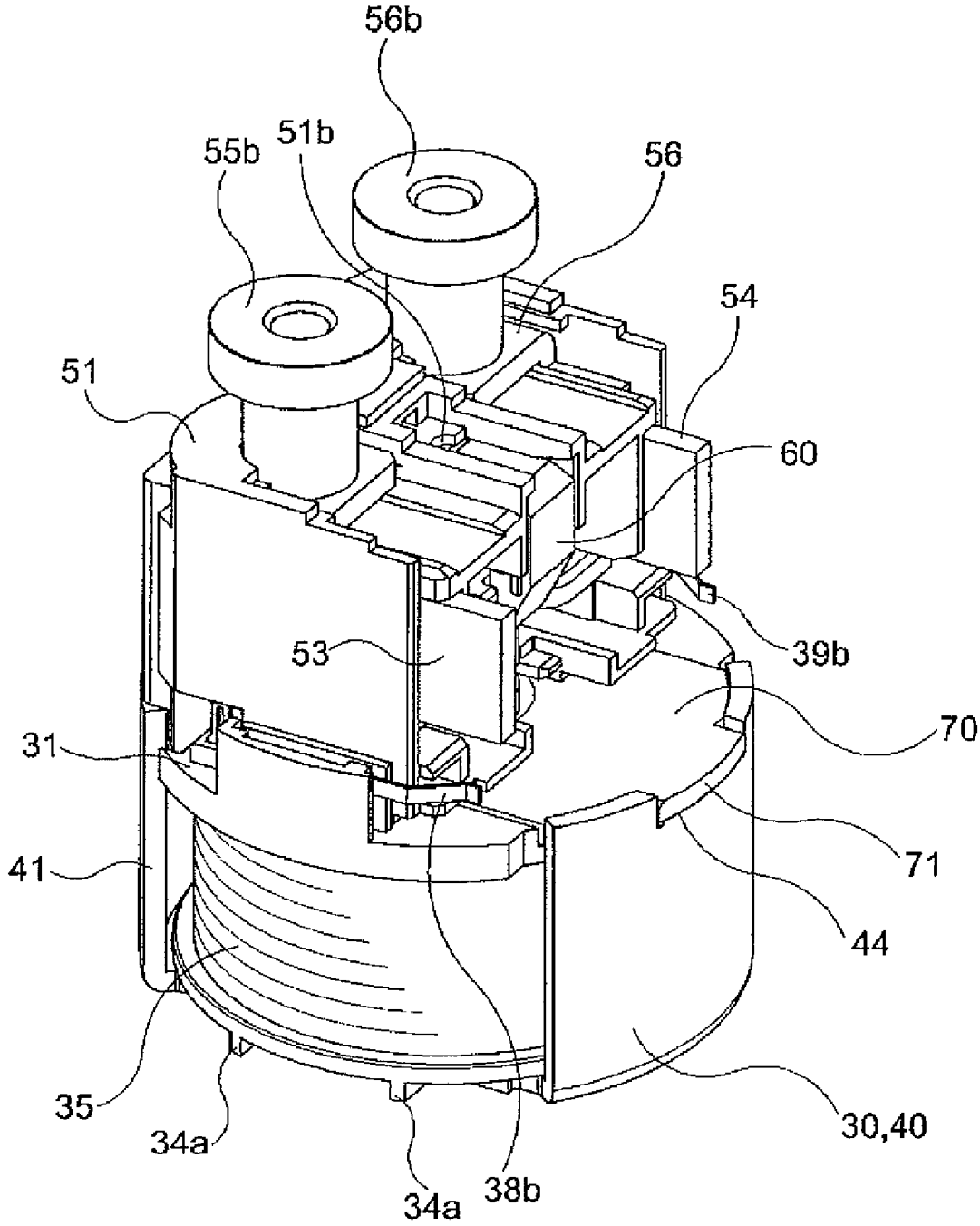
FIG. 7 is a perspective view illustrating the electromagnet unit and the contact-point mechanism unit which are halfway through assembling.

As illustrated in FIG. 6, the first base 51 is a resin molded article having plural guide slots which enable assembling, therewith, the fixed contact-point terminals 55 and 56 and the like in the lateral direction and, further, is provided with protrusions 51*a* (FIG. 8B) protruded from its bottom surface for securing, through caulking, the secondary yoke 70.

As illustrated in FIG. 4, the second base 52 is shaped such that it is assembled with the first base 51 to cover the movable contact-point block 60, thereby enhancing the insulation property thereof. Further, an adjustment hole 51*b* (FIG. 6) which enables viewing the movable contact-point block 60 from thereabove is formed between the second base 52 and the first base 51. Further, the second base 52 is adapted to enable the pair of coil terminals 81 and 82 to be mounted to the outer side surface thereof in the lateral direction.

The plate-shaped permanent magnets 53 and 54 are for erasing the arc generated at the time of opening and closing of the contact points with magnetic forces generated therefrom, in order to extend the life of the contact points. Further, the permanent magnets 53 and 54 induce dusts caused by the arc not to adhere to the surfaces of the contact points, thereby preventing the occurrence of contact failures. Accordingly, the plate-shaped electromagnets 53 and 54 are press-fitted in the guide slots in the first base 51 and, therefore, are placed in parallel in such a way as to sandwich, therebetween, a movable contact piece 64 which will be described later.

As illustrated in FIG. 6, the pair of fixed contact-point terminals 55 and 56 have a substantially U shape at their side surfaces and have fixed contact points 55*a* and 56*a* provided on the lower sides of their inner peripheral surfaces and terminal portions 55*b* and 56*b* having female screws provided on the upper sides of their outer peripheral surfaces.

Figure 11A:
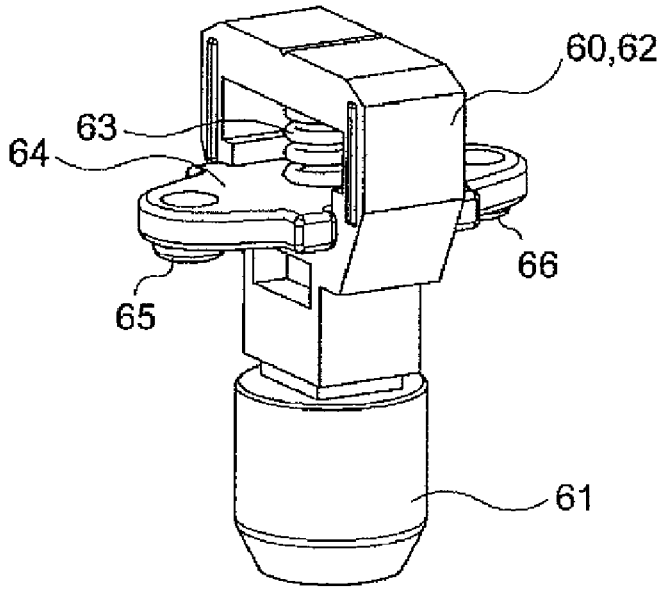
FIGS. 11A, 11B and 11C are a perspective view, a side view and a longitudinal cross-sectional view of a movable contact-point block.
Figure 11B:
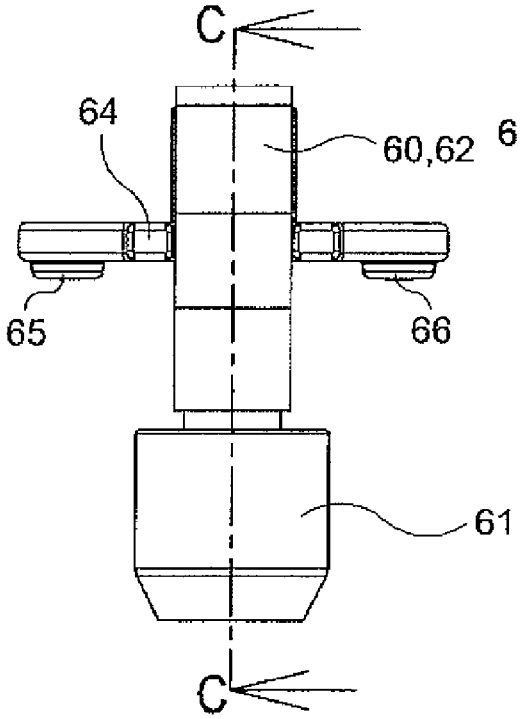
Figure 11C:
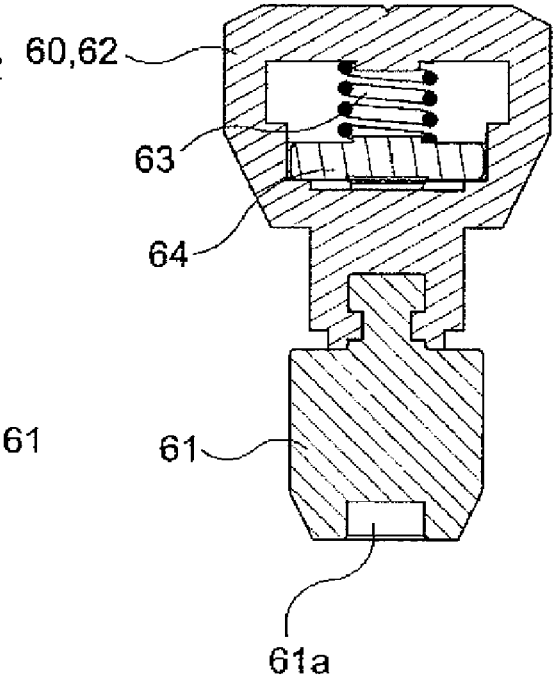
Figure 12:
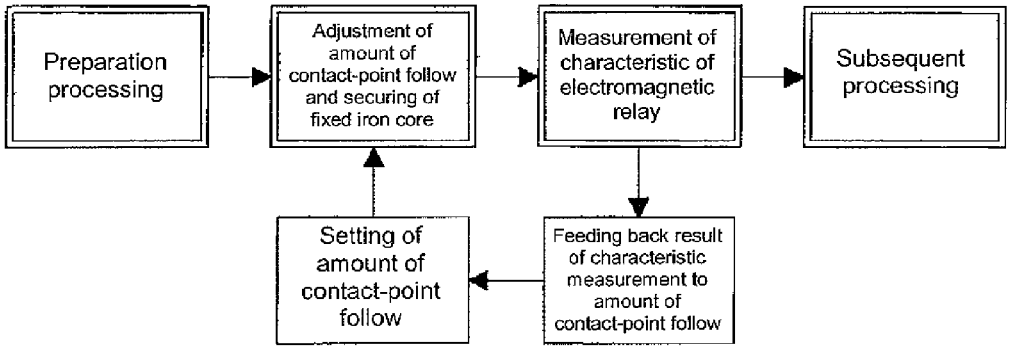
FIGS. 12A, 12B and 12C are a processing block diagram, a flow chart and a block diagram illustrating adjustment operations according to the first embodiment.
Figure 12:
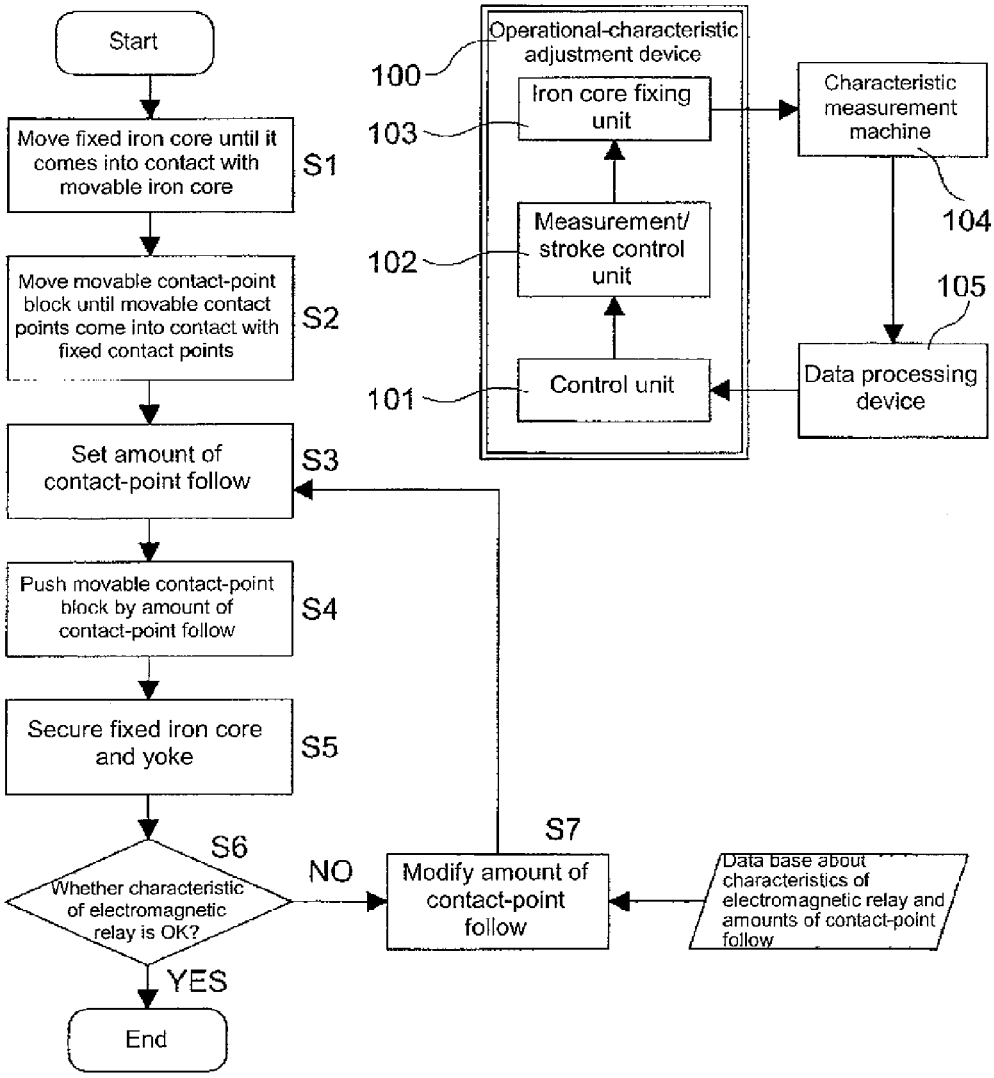

As illustrated in FIGS. 6 and 11, the movable contact-point block 60 includes an insulation annular holder 62 formed integrally with the upper end portion of the movable iron core 61 and is structured such that the movable contact piece 64 is supported while being downwardly biased by a contact pressing spring 63 within the annular holder 62. The movable iron core 61 is provided with a narrow neck portion at its upper end portion and, thus, is shaped to reduce the possibility of disengagement of the annular holder 62 therefrom (FIG. 11). Further, the shape of the upper end portion of the movable iron core 61 is not limited to a narrow neck shape and can be also a male screw shape, for example. Further, the movable iron core 61 is provided, in its lower end surface, with a concave portion 61*a* which allows a restoring spring 45 to be fitted therein (FIG. 11C). Further, movable contact points 65 and 66 are formed, through protruding processing, on the edge portions of the lower surface of the movable contact piece 64 at its opposite sides. Further, concave and convex portions for preventing disengagement are formed by ejection at a center portion of the movable contact piece 64. Further, the movable contact-point block 60 is inserted into the first base 51 along a guide slot therein in the lateral direction and is housed therein such that it is slidable in the upward and downward directions.

As illustrated in FIG. 6, the secondary yoke 70 has a planer shape which can be placed between the pedestal portions 36 and 37 provided on the collar portion 33 of the spool 31 and, also, has, at its opposite end edge portions, extending tongue pieces 71 and 71 which are to be secured to the cutout portion 44 of the yoke 40. Further, the secondary yoke 70 is provided, at its center portion, with a through hole 73 having an annular rib 72 protruded at its lower opening edge portion. Further, the caulking protrusions 51*a* (FIG. 8B) protruded from the bottom surface of the first base 51 are fitted in caulking holes 74 and secured thereto through caulking, so that the secondary yoke 70 is integrated with the first base 51.

As illustrated in FIG. 4, the coil terminals 81 and 82 are formed from conductive members which are bent to have a substantially L shape at their side surfaces, and their vertical lower end portions are formed as connection portions 81*a* and 82*a*, and terminal portions 81*b* and 82*b* with female threaded portions are secured to the horizontal portions of their upper sides. Further, the coil terminals 81 and 82 are assembled with the outer side surface of the second base in the lateral direction.

The insulation cover 83 is for covering the coil terminals 81 and 82 for enhancing the insulation property, as illustrated in FIG. 4. Further, the insulation cover 83 is fitted to the second base 52 from thereabove, so that the terminal portions 81*b* and 82*b* of the coil terminals 81 and 82 are protruded through terminal holes 84 and 85 therein. Further, a gas venting hole 86 in the insulation cover 83 is not overlapped with the adjustment hole 51*b*, and a protruding piece 87 extending in the lateral direction from the insulation cover 83 covers the adjustment hole 51*b*.

Next, there will be described an assembling method and an adjustment method according to the present embodiment.

At first, the yoke 40 is assembled with the spool 31 around which the coil 35 has been wound, and the yoke 40 is positioned with the pair of substantially-U-shaped protrusions 34*a* protruded from the lower surface of the collar portion 34 of the spool 31. Thus, the pedestal portions 36 and 37 of the spool 31 are positioned within the ranges of the side opening portions 41 and 41 of the yoke 40, respectively. Accordingly, the relay terminals 38 and 39 which are press-fitted to the pedestal portions 36 and 37 are positioned within the ranges of the side opening portions 41, which enables effective utilization of the space, thereby providing an electromagnet unit 30 with a smaller bottom area. Further, the longitudinal axis of the winding body portion 32 of the spool 31 passes through the side opening portions 41 and 41 of the yoke 40. This offers the advantage of increase of the number of windings of the coil 35 by at least an amount corresponding to the thickness of the yoke 40.

On the other hand, the pair of plate-shaped permanent magnets 53 and 54 are press-fitted to the first base 51, and the pair of fixed contact-point terminals 55 and 56 are press-fitted thereto in the lateral direction. Further, the movable contact-point block 60 is assembled with the first base 51 and is housed therein slidably in the upward and downward directions and, also, the caulking holes 74 in the secondary yoke 70 are fitted to the caulking protrusions 51*a* on the first base 51, so that the secondary yoke 70 is secured to the first base 51 through caulking.

Further, the tongue pieces 71 and 71 of the secondary yoke 70 which has been secured, through caulking, to the first base 51 are caused to straddle the cutout portions 44 and 44 of the yoke 40 which has been assembled with the spool 31, and they are secured to each other through caulking, so that the electromagnet unit 30 and the contact-point mechanism unit 50 are integrated with each other.

Figure 8B:
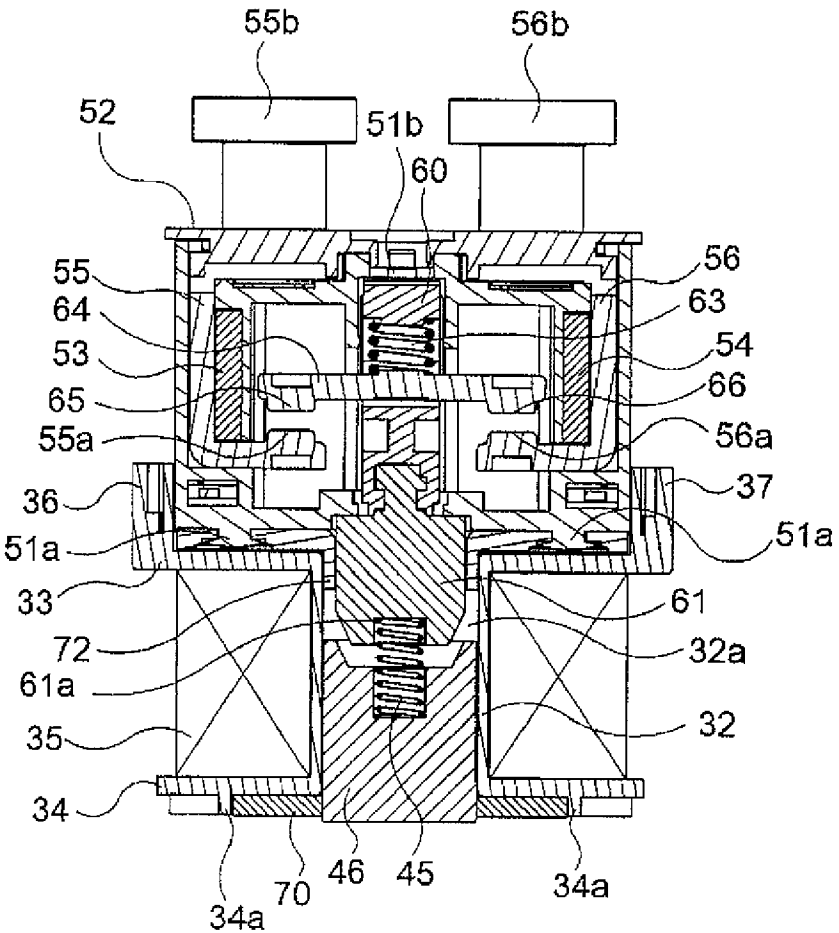
FIGS. 8A and 8B are a side view and a longitudinal cross-sectional view of the electromagnet unit and the contact-point mechanism unit which have been integrated with each other.
Figure 8A:
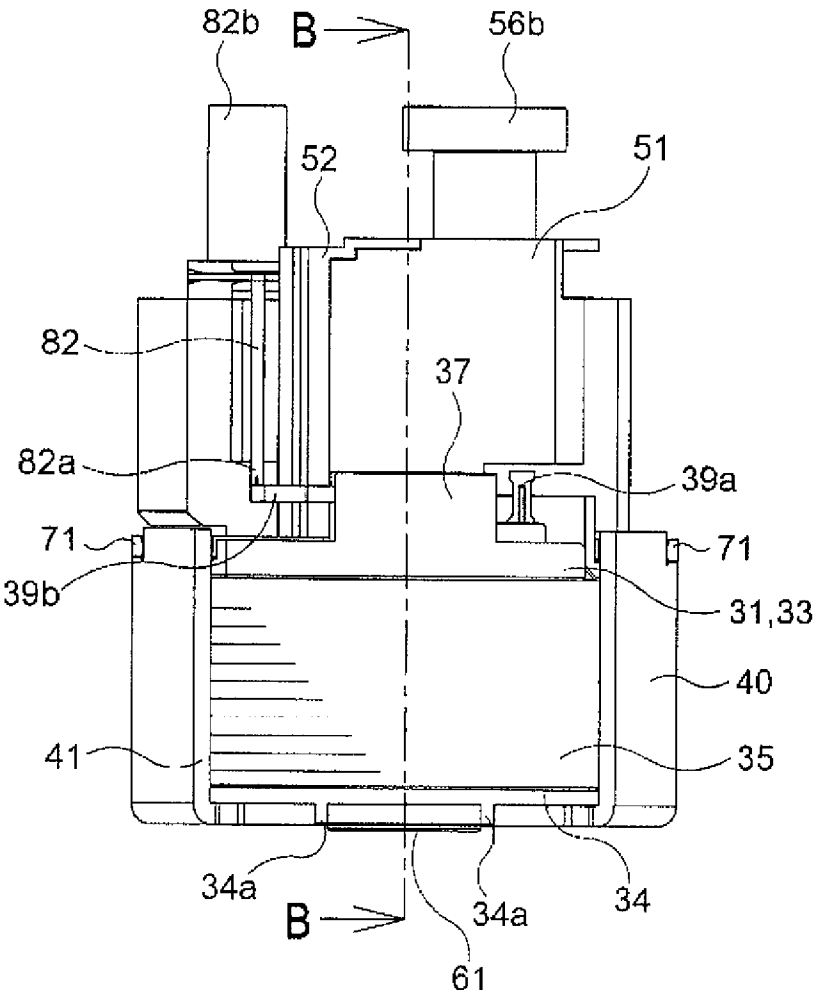

Further, the second base 52 is fitted to the first base 51 and thereafter the coil terminals 81 and 82 are assembled with the second base 52 for bringing the connection portions 81*a* and 82*a* of the coil terminals 81 and 82 into contact with the connection portions 38*b* and 39*b* of the relay terminals 38 and 39 and then they are integrated with each other through welding (FIG. 8A). Subsequently, the restoring spring 45 is inserted in the axial hole 32*a* in the winding body portion 32 of the spool 31, and the fixed iron core 46 is press-fitted in the through hole 43 in the yoke 40 and, thus, the fabrication of an intermediate product is completed.

Next, there will be described a method for adjusting an operation characteristic of the intermediate product.

Adjustment operations according to the present embodiment are conducted based on procedures illustrated in FIG. 12A. That is, the intermediate product is adjusted according to an amount of contact-point follow which has been preliminarily set for the intermediate product, then the fixed iron core 46 is secured to the yoke 70 and, thereafter, a characteristic thereof is measured. Further, the result of measurement is fed back to the setting of the amount of contact-point follow to set a new amount of contact-point follow and, thereafter, the same adjustment operations are repeated.

The adjustment operations will be described in more detail. As illustrated in FIGS. 12C and 13A, at first, the intermediate product is housed in a box-shaped base table 91 placed in a measurement/stroke control unit 102 in an operational-characteristic adjustment machine 100. Further, a jig pin 92 is brought into contact with the bottom surface of the fixed iron core 46 through a center hole 90 provided through the bottom surface of the box-shaped base table 91, and a pressing plate 94 having a through hole 93 is brought into contact with the upper surface of the intermediate product, so that the intermediate product is sandwiched therebetween.

Figure 13B:
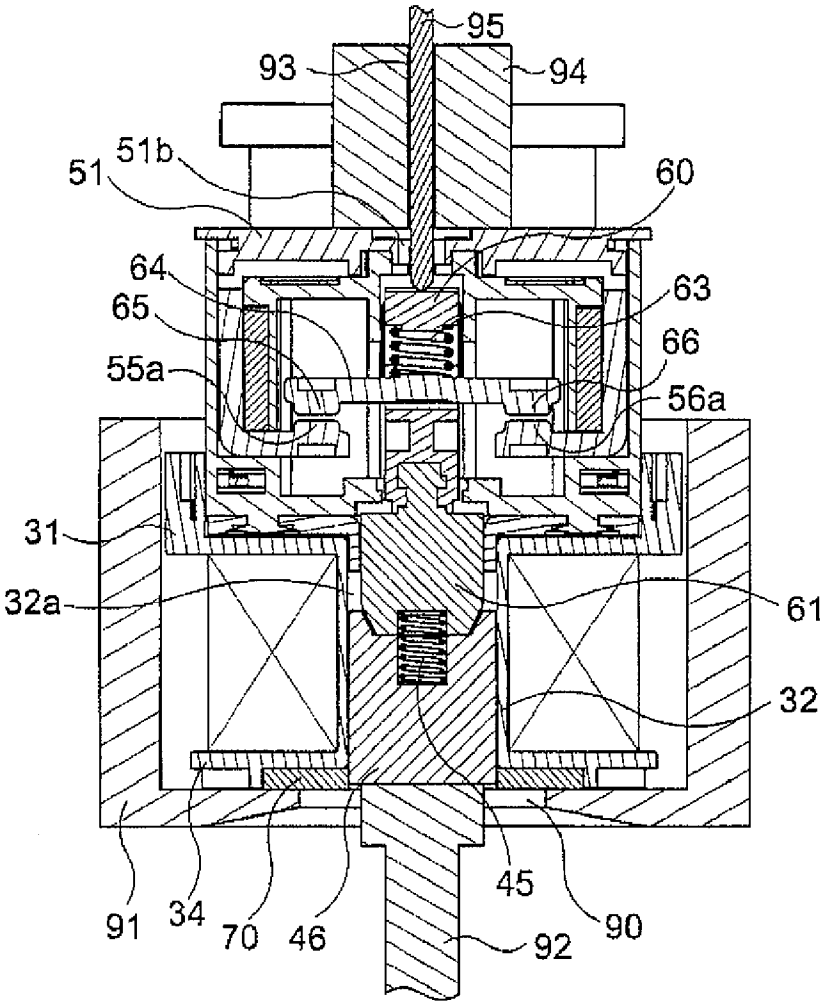
FIGS. 13A and 13B are longitudinal cross-sectional views for describing adjustment operations.
Figure 13A:
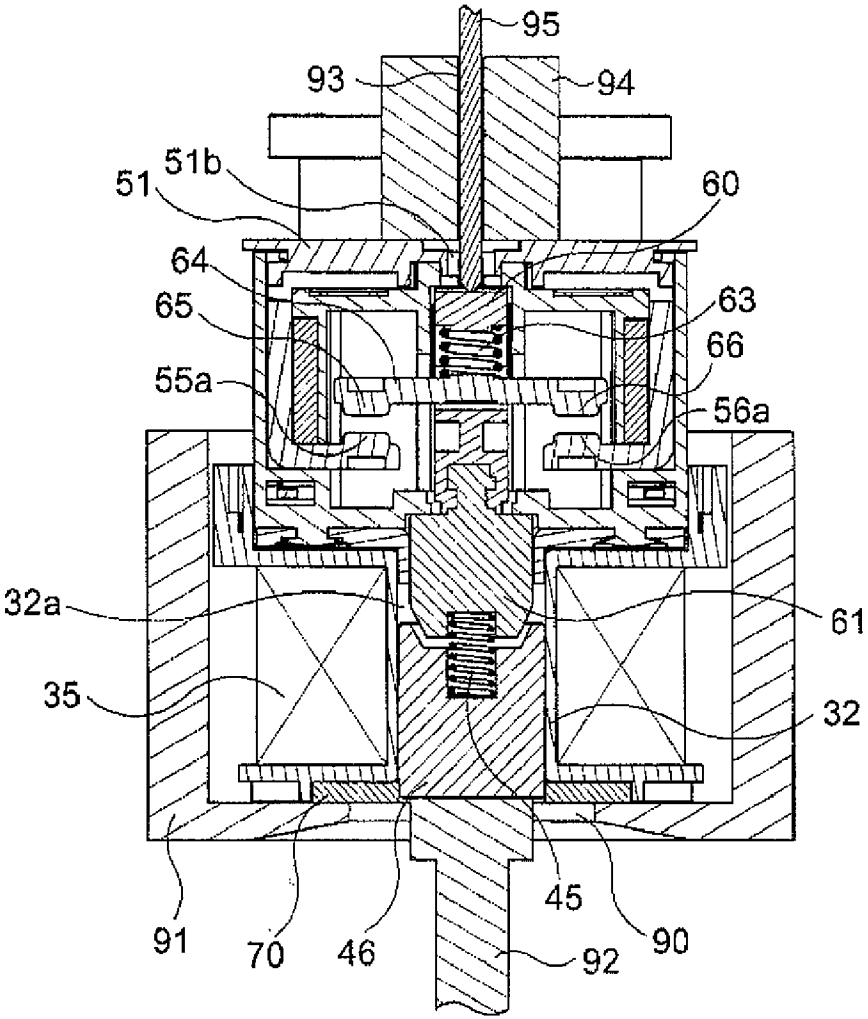
Figure 14B:
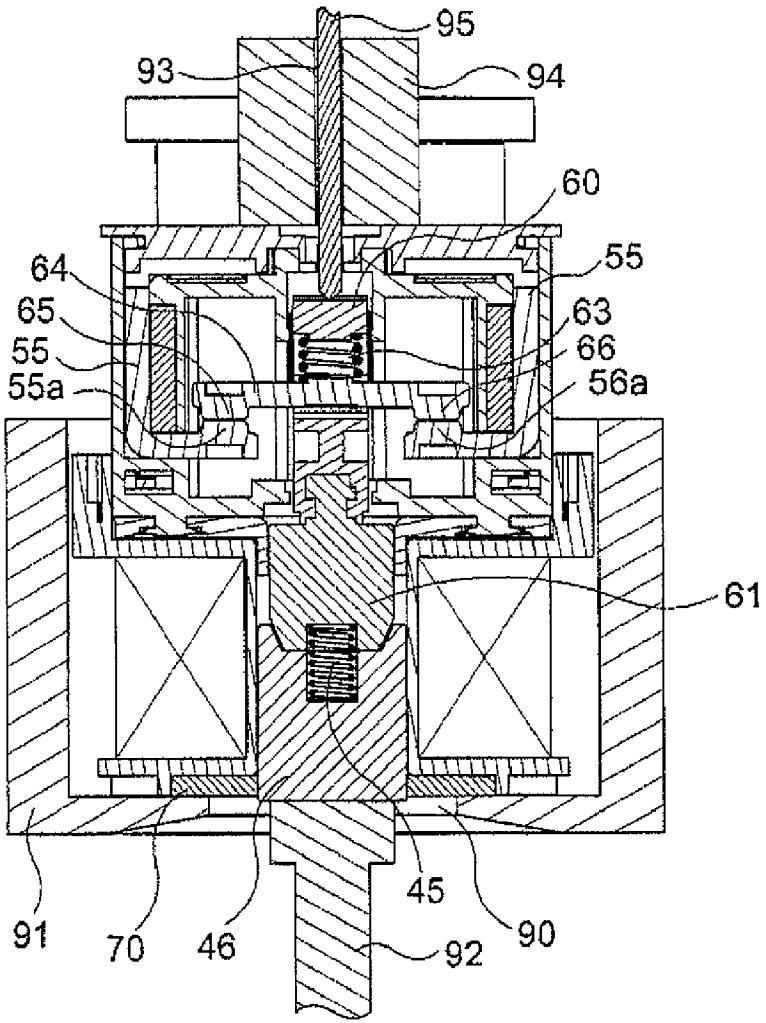
FIGS. 14A and 14B are longitudinal cross-sectional views for describing adjustment operations subsequent to FIG. 13.
Figure 14A:
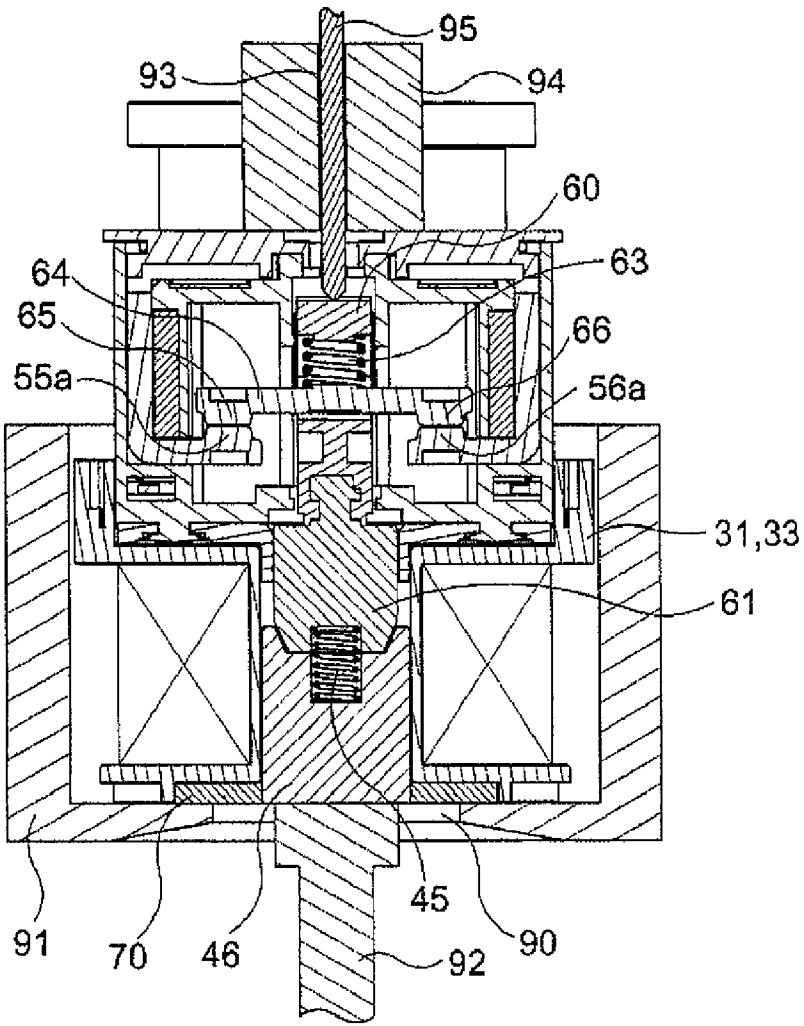
Figure 15:
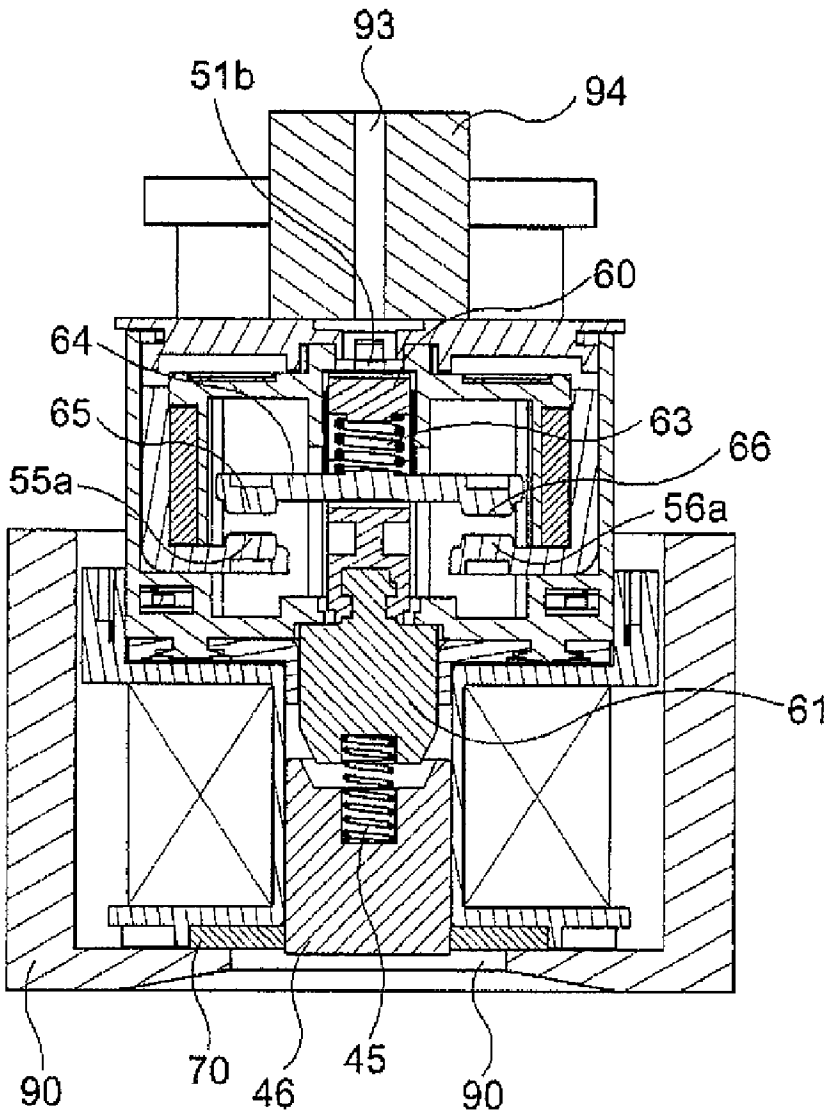
FIG. 15 is a longitudinal cross-sectional view for describing adjustment operations subsequent to FIG. 14.

Further, in step S1, a probe 95 is downwardly pushed through the adjustment hole 51*b* in the first base 51 and through the through hole 93 in the pressing plate 94 (FIG. 12B), which causes the movable contact-point block 60 to descend against the spring force of the restoring spring 45, thereby bringing the movable iron core 61 into contact with the fixed iron core 46 (FIG. 13B). In step S2, the probe 95 is further downwardly pushed, which causes the movable contact-point block 60 to descend, thereby bringing the movable contact points 65 and 66 into contact with the fixed contact points 55*a* and 56*a* (FIG. 14A). In step S3, an amount of contact-point follow is set and, in step S4, the probe 95 is downwardly pushed by an amount corresponding to the amount of contact-point follow, which causes the movable iron core 61 of the movable contact-point block 60 to push the fixed iron core 46 downwardly against the spring force of the contact pressing spring 63, thereby ensuring a predetermined amount of contact-point follow (FIG. 14B). Further, in step S5, at this state, the fixed iron core 61 is secured to the yoke 40 through welding. Subsequently, in step S6, a characteristic measurement machine 104 determines a characteristic of the electromagnetic relay for determining whether it is proper or improper and, if the characteristic is improper, the intermediate produce is extracted from the assembling line. Further, in step S7, the amount of contact-point follow is modified based on a data base about characteristics of the electromagnetic relay and amounts of contact-point follow and, then, the processing is returned to step S3. On the other hand, if the characteristic is proper, the adjustment operations are completed without setting the amount of contact-point follow, and the probe 95 and the jig pin 92 are removed (FIG. 15) and thereafter subsequent processing is conducted.

As a method for modifying the amount of contact-point follow, for example, as illustrated in FIG. 12C, measurement and detection of a two-stage operating voltage are conducted, using the characteristic measurement machine 104, for the intermediate product created by integrating, through welding, the fixed iron core 46 and the movable iron core 61, with an iron core fixing unit 103 in the operational-characteristic adjustment device 100. Such a two-stage operating voltage is the difference between an operating voltage with which an operation of the movable contact-point block 60 in the intermediate product is started and a complete operating voltage with which the movable iron core 61 is completely sucked by the fixed iron core 46. Further, based on correlation between past two-stage operating voltages and amounts of contact-point follow, an optimum amount of contact-point follow is calculated by a data processing device 105, based on the two-stage operating voltage which has been actually detected. Subsequently, the result of the calculation is transmitted to a control unit 101 in the operational-characteristic adjustment device 100, which modifies the amount of pushing by the probe 95 and the like in the measurement/control-stroke control unit 102. Accordingly, if the two-stage operating voltage is excessively large, for example, it is considered that the amount of pushing by the probe is excessively large and, therefore, the amount of contact-point follow, namely the amount of pushing by the probe is modified to be reduced, based on the correlation between past two-stage operating voltages and amounts of contact-point follow.

Note that the characteristic measurement machine 104 is illustrated at a position distant from the operational-characteristic adjustment device 100, for ease of description, but it is incorporated in the operational-characteristic adjustment device 100.

With the adjustment operations according to the present embodiment, it is possible to eliminate the variations in the component accuracy and the assembling accuracy through the adjustment operations, thereby offering the advantage of provision of an electromagnetic relay with no variation in operational characteristics and with a higher yield. Further, it is possible to conduct the adjustment operations and the measurement operations continuously in the same step, thereby increasing the operation efficiency. Further, it is possible to feed back the result of measurement of the operational characteristic to a most recent electromagnetic relay, thereby offering the advantage of improvement of the yield.

Further, the insulation cover 83 is assembled with the second base 52 in the intermediate product which has been subjected to adjustment operations to cover the coil terminals 81 and 82. Further, as illustrated in FIG. 3, the intermediate product is housed in the metal case 21, the metal cover 22 is fitted thereto and integrated therewith through welding and, thereafter, a gas venting pipe 27 is inserted through the gas venting hole 26 in the metal cover 22 and the gas venting hole 86 in the insulation cover 83. Subsequently, a sealing material 28 is injected into the concave portion 23 of the metal cover 22 and is solidified therein for sealing it. Then, internal gas is eliminated, through suction, from the gas venting pipe 27 and thereafter the gas venting pipe 27 is thermally sealed and thus the fabrication of the electromagnetic-relay main body 20 is completed.

Figure 2:
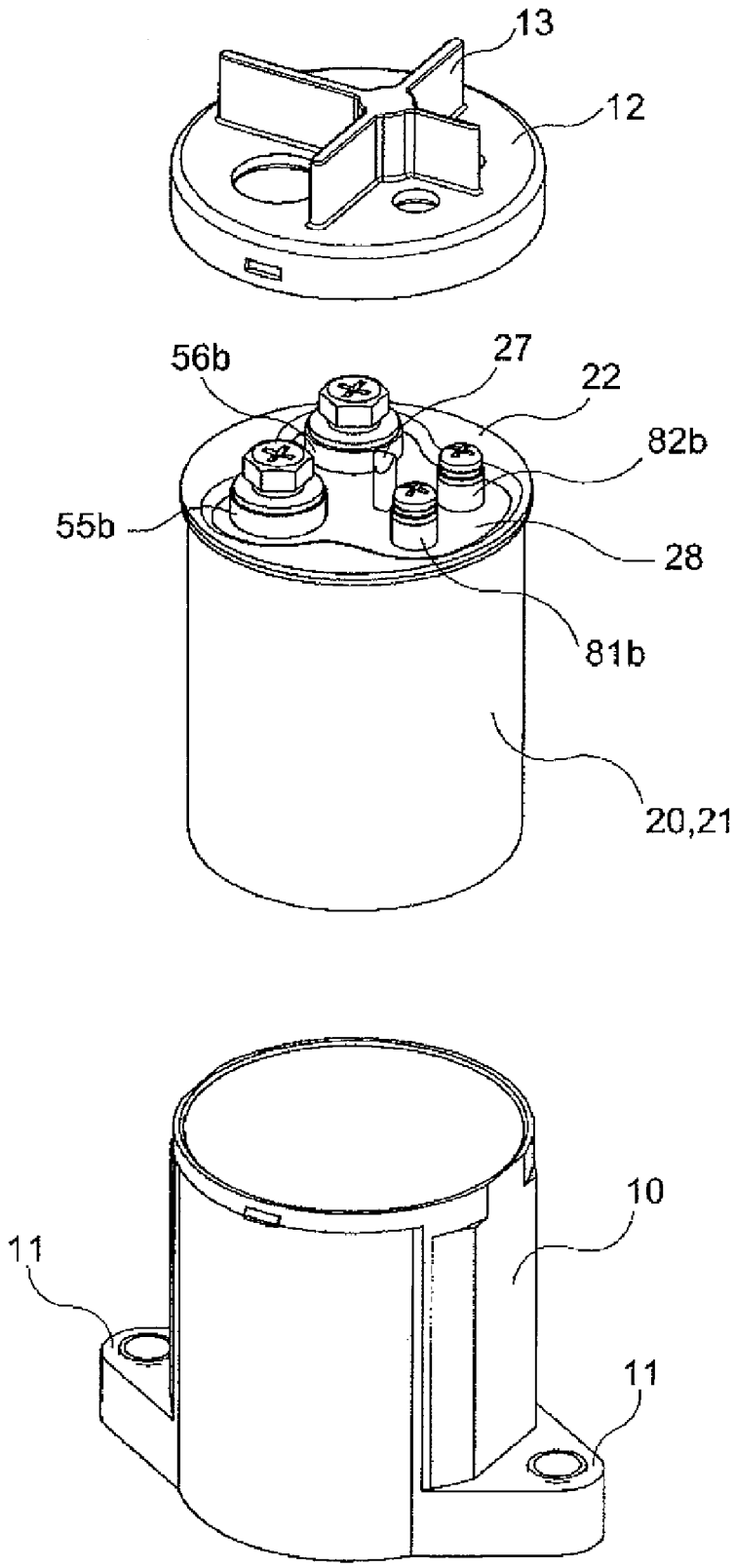
FIG. 2 is an exploded perspective view of the electromagnetic relay illustrated in FIG. 1.

Subsequently, as illustrated in FIG. 2, the electromagnetic-relay main body 20 is housed within the resin case 10 and the resin cap 12 is fitted thereto to complete the assembling operations of the electromagnetic relay.

Operational characteristics according to the present embodiment will be described.

Figure 9B:
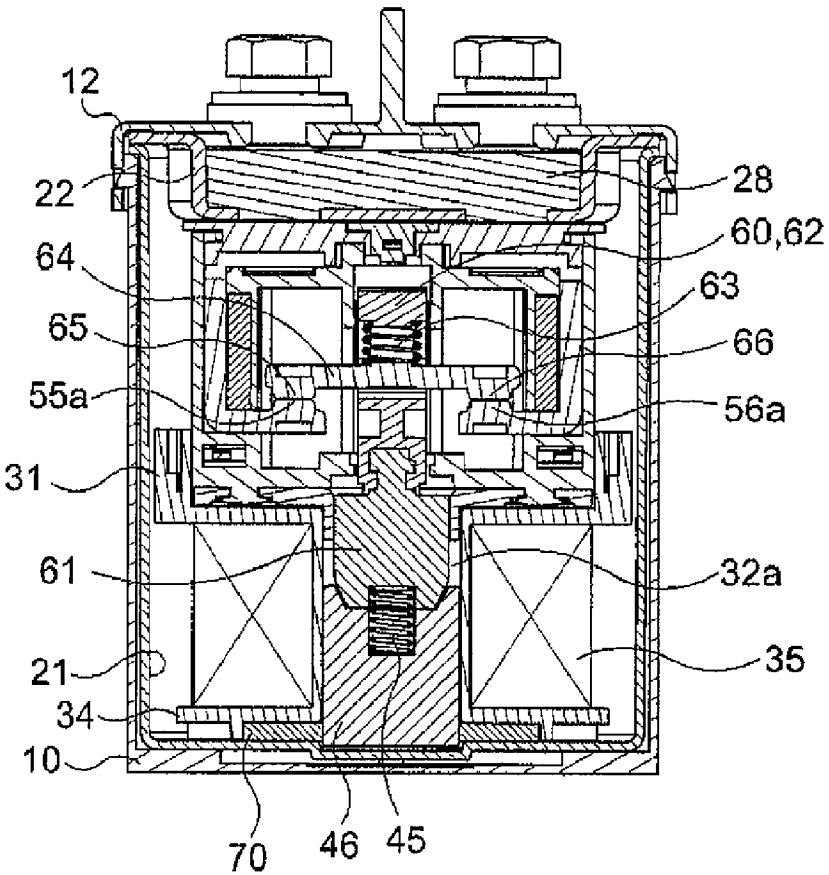
FIGS. 9A and 9B are longitudinal cross-sectional views illustrating the electromagnetic relay before and after an operation.
Figure 9A:
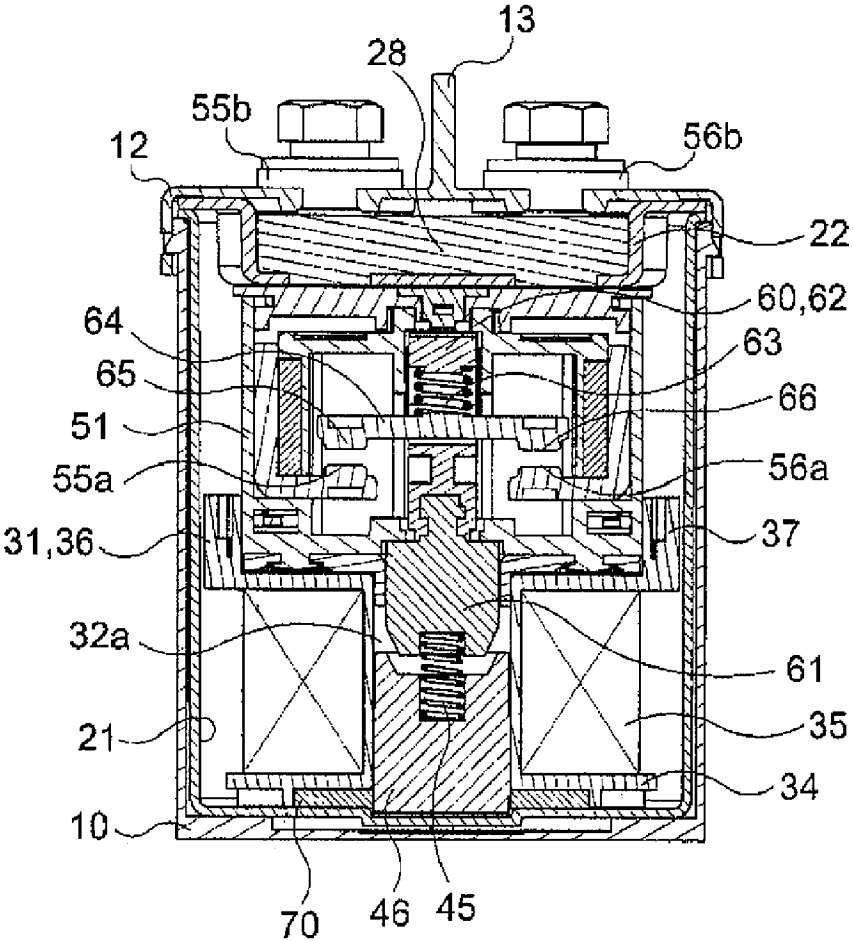

When no voltage is applied to the coil 35, the movable contact-point block 60 is pushed upwardly by the spring force of the restoring spring 45, as illustrated in FIG. 9A. Accordingly, the movable contact points 65 and 66 are separated from the fixed contact points 55*a* and 56*a*.

Subsequently, if a voltage is applied to the coil 35, as illustrated in FIG. 9B, this causes the fixed iron core 46 to suck the movable iron core 61 in the movable contact-point block 60, thereby causing the movable contact-point block 60 to descend against the spring force of the restoring spring 45. Then, after the movable contact points 65 and 66 come into contact with the fixed contact points 55*a* and 56*a*, the movable iron core 61 is further sucked. This causes the annular holder 62 to descend against the spring force of the contact pressing spring 63 and, also, causes the movable contact points 65 and 66 to be press-contacted with the fixed contact points 55*a* and 56*a* with a predetermined contact-point pressure. Thereafter, the movable iron core 61 is sucked by the fixed iron core 46.

Further, if the application of the voltage to the coil 35 is stopped, this causes the movable iron core 61 to be pushed upwardly by the spring forces of the restoring spring 45 and the contact pressing spring 63, which separates the movable iron core 61 from the fixed iron core 46 and then restores the contact pressing spring 63 to the original shape, thereby separating the movable contact points 65 and 66 from the fixed contact points 55*a* and 56*a* to cause restoration to the original state.

Figure 10A:
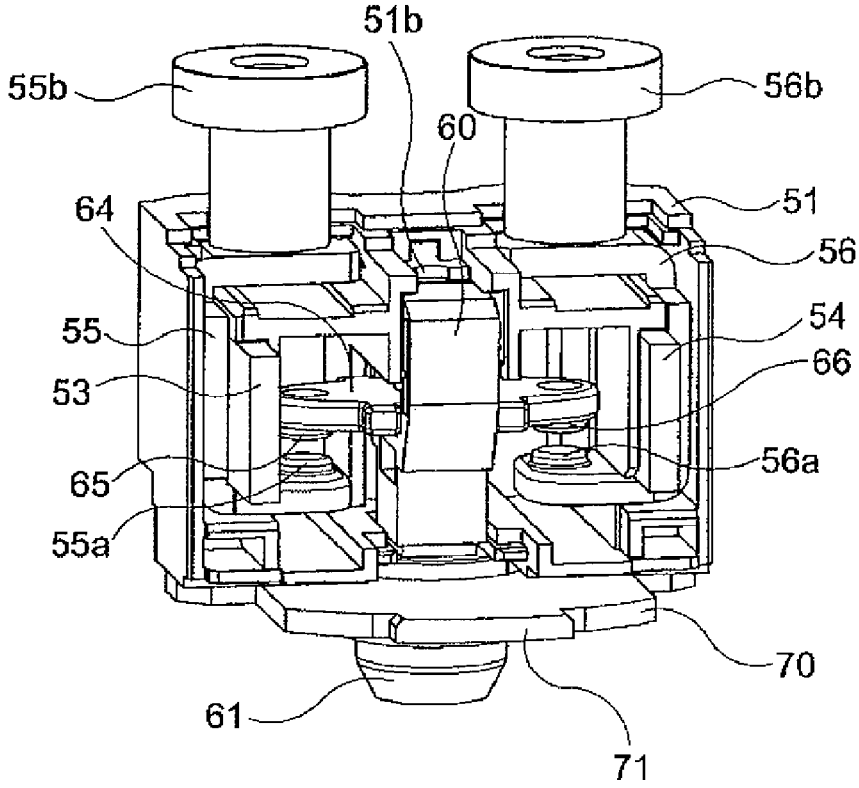
FIGS. 10A and 10B are a perspective view and a cross-sectional view of the contact-point mechanism unit according to the first embodiment.
Figure 10B:
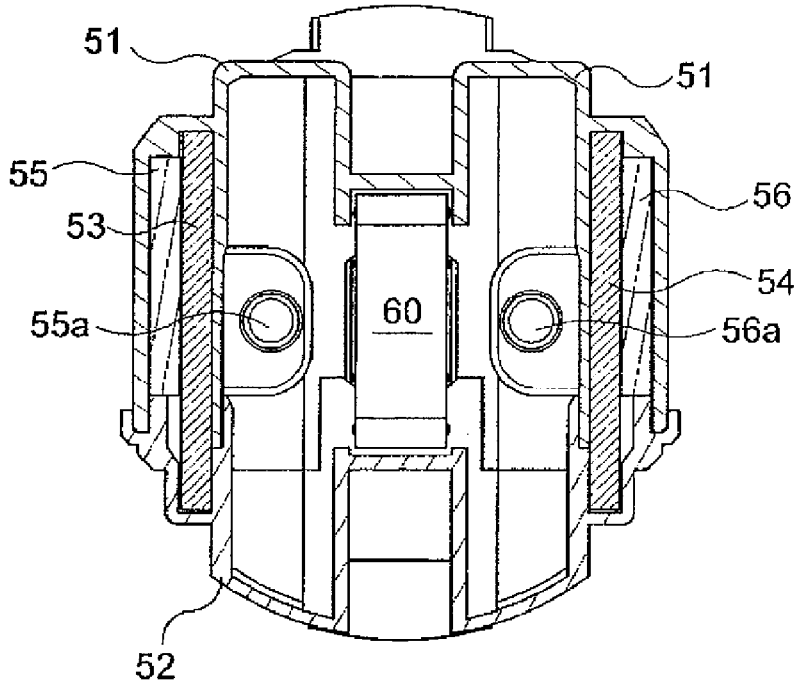

In the present embodiment, even if an arc is generated at the time of opening and closing of the contact points, as illustrated in FIG. 10, the arc is drawn in the outward direction (in the upward and downward directions in FIG. 10B) to be erased, due to the magnetic forces (Lorentz forces) of the magnetic fields generated from the pair of plate-shaped permanent magnets 53 and 54 which are press-fitted to the first base 51. This reduces the possibility of the occurrence of welding of the contact points. Further, dusts and the like induced by the occurrence of the arc are also led to positions distant from the fixed contact points 55*a* and 56*a*, which reduces the possibility of adhesion of them to the surfaces of the contact points, thereby reducing the possibility of the occurrence of contact failures. This can offer the advantage of provision of an electromagnetic relay having contact points with an increased life and with higher contact reliability. Also, heat-resistant ceramics can be placed at predetermined positions on the inner side surfaces of the first and second bases 51 and 52. This is because the ceramics placed therein can absorb the heat of the generated arc, which is effective in erasing the arc, and, also, can protect the first base 51 and the like from the arc.

As the adjustment method, there have been described the adjustment operations after the secondary yoke 70 is secured to the yoke 40, but the adjustment method is not necessarily limited thereto and can be other adjustment methods.

Figure 16C:
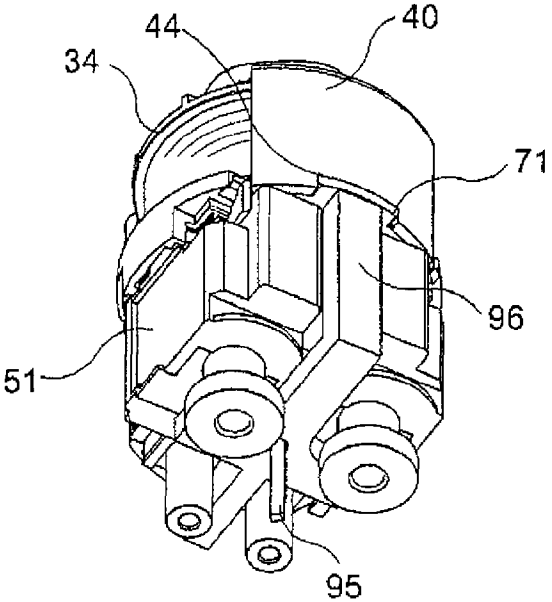
FIGS. 16A, 16B and 16C are a plan view, a longitudinal cross-sectional view and a perspective view which are describing different adjustment operations.
Figure 16B:
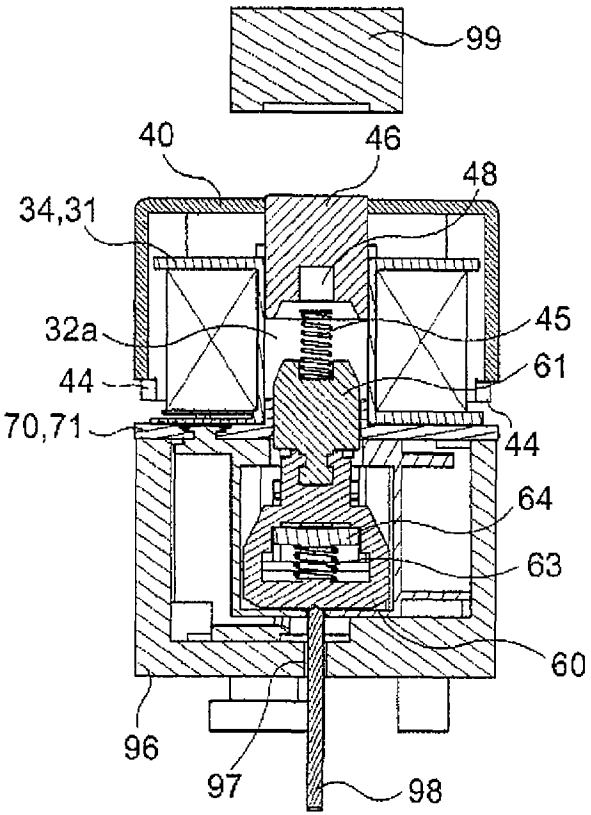
Figure 16A:
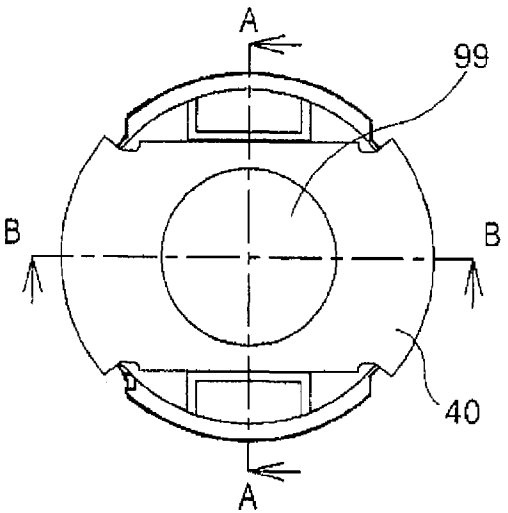
Figure 17A:
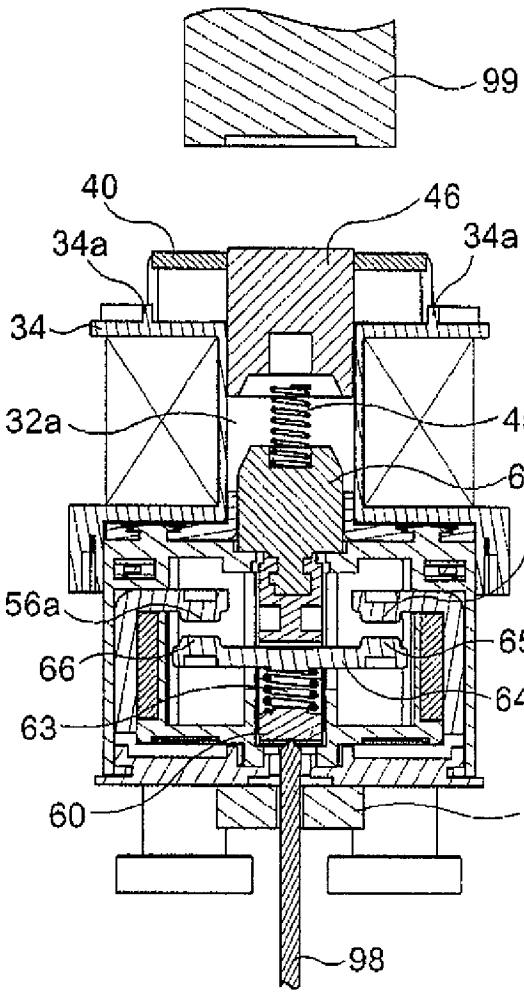
FIGS. 17A, 17B and 17C are longitudinal cross-sectional views for describing adjustment operations subsequent to FIG. 16.
Figure 17B:
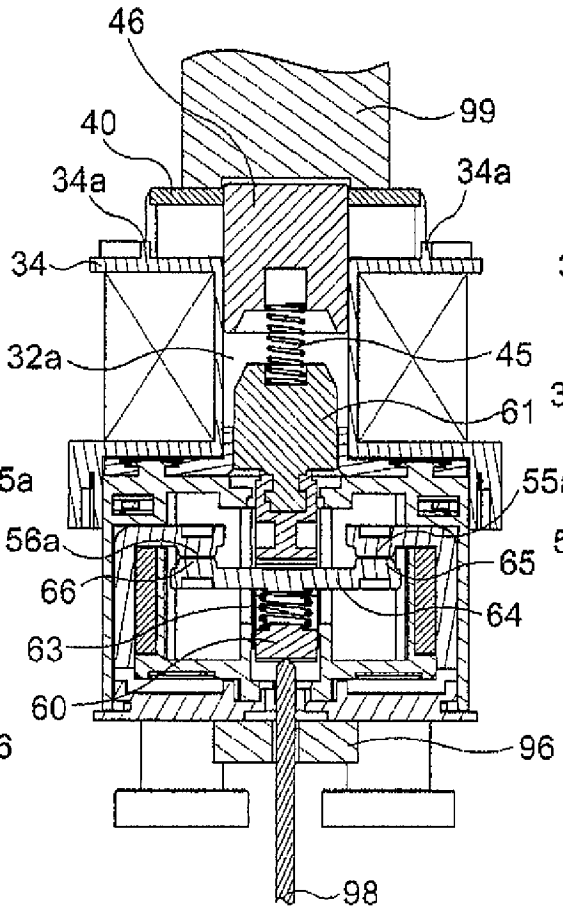
Figure 17C:
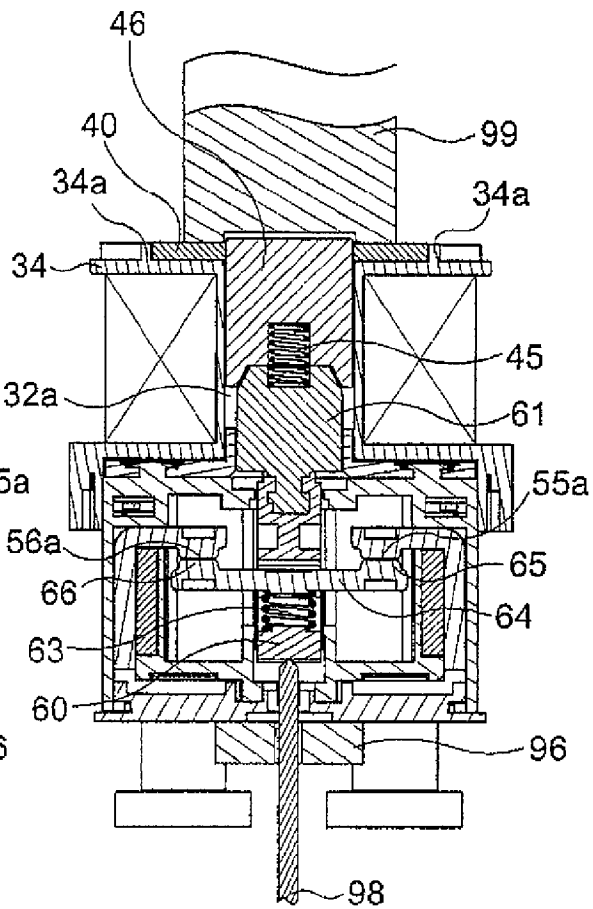

For example, as illustrated in FIGS. 16 and 17, an intermediate product created by preliminarily securing the fixed iron core 46 to the yoke 40 though caulking, welding or the like without securing the secondary yoke 70 to the yoke 40 is mounted to a box-shaped base table 96 (FIGS. 16B and 17A), and a pushing jig 99 is brought into contact with the yoke 40. Further, the movable contact-point block 60 is pushed upwardly by a probe 98 through an adjustment hole 97 in the box-shaped base table 96, which brings the movable contact points 65 and 66 into contact with the fixed contact points 55*a* and 56*a*. Further, in order to ensure a predetermined amount of contact-point follow, the probe 98 is pushed thereinto against the spring force of the contact pressing spring 63 and then is stopped (FIG. 17B). Then, the pushing jig 99 is descended to push in the yoke 40 and, at the time when the fixed iron core 46 comes into contact with the movable iron core 61, the pushing jig 99 is stopped. At this state, the tongue pieces 71 of the secondary yoke 70 are secured to the cutout portions 44 of the yoke 40 through welding or the like (FIG. 16C) to complete the adjustment operations. After the adjustments, measurement of a characteristic is conducted, and the result of measurement is fed back for modifying the amount of contact-point follow, which is the same as in the above adjustment system.

According to the present embodiment, the tongue pieces 71 of the secondary yoke 70 can be secured to the cutout portions 44 of the yoke 40, which facilitates the securing operations and also offers a wide variety of options of adjustment methods, thereby offering the advantage of increase of the operation efficiency.

Figure 18A:
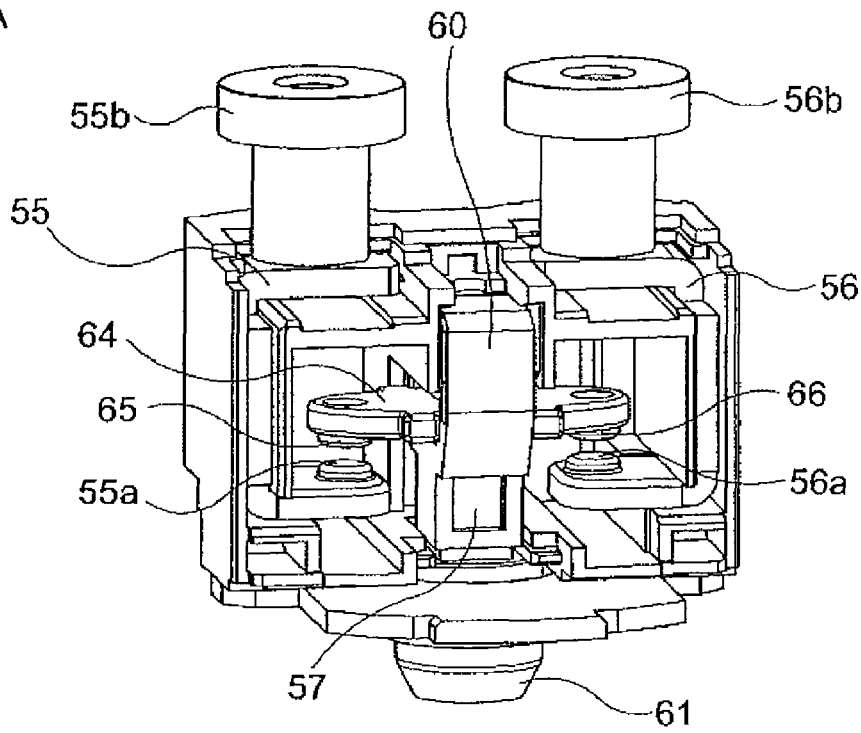
FIGS. 18A and 18B are a perspective view and a cross-sectional view of a contact-point mechanism unit, illustrating a second embodiment of the electromagnetic relay according to the present invention.
Figure 18B:
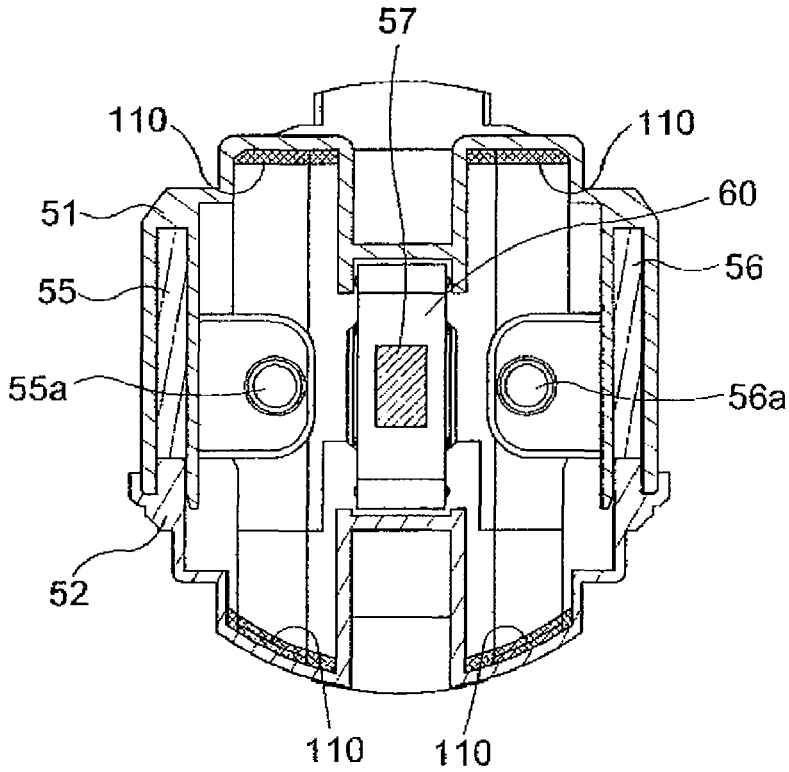
Figure 19A:
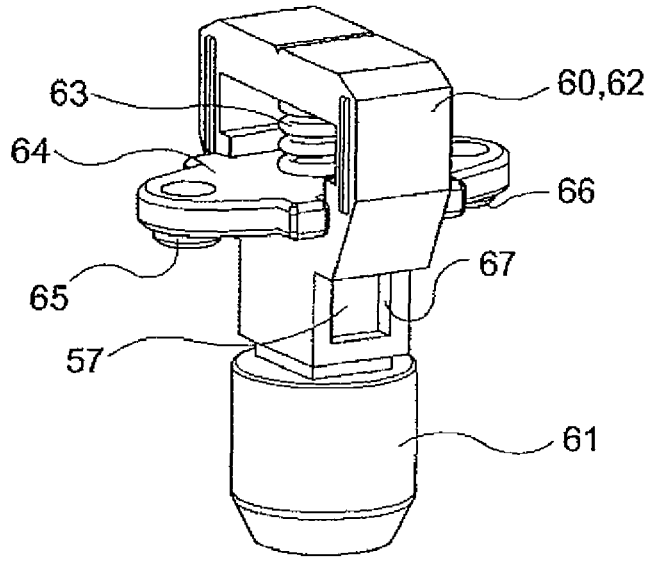
FIGS. 19A, 19B and 19C are a perspective view, a side view and a longitudinal cross-sectional view of a movable contact-point block illustrated in FIG. 18.
Figure 19B:
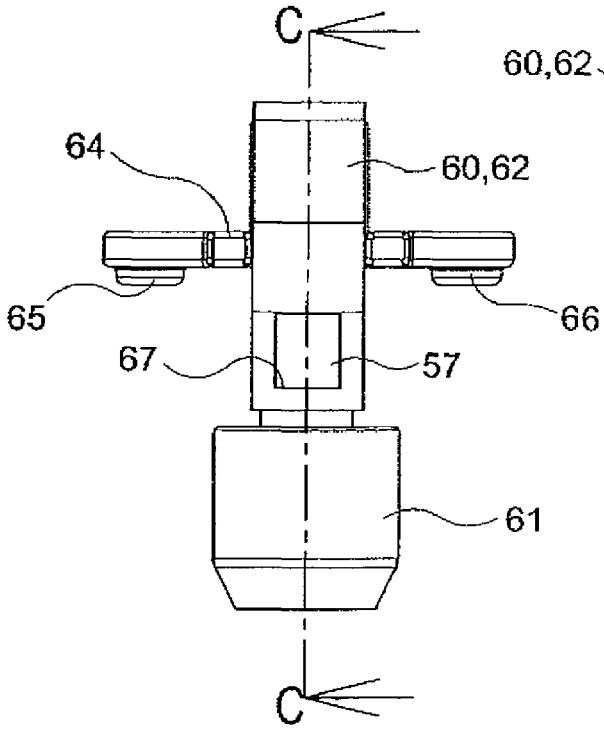
Figure 19C:
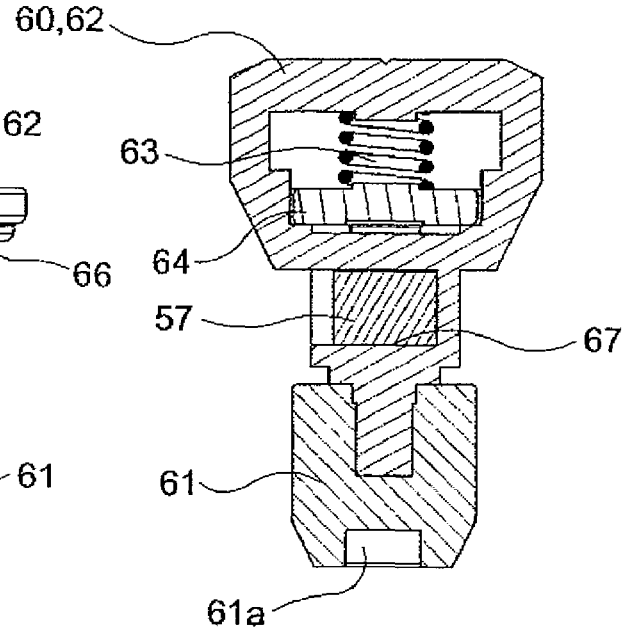

A second embodiment is a case where a permanent magnet 57 is press-fitted in and held by a movable block 60, as illustrated in FIGS. 18 and 19. That is, the permanent magnet 57 is press-fitted in and held by a concave portion 67 provided in the base portion of an insulation annular holder 62. In the present embodiment, the movable block 60 has such an outer shape as to allow it to be replaced with the movable contact-point block 60 according to the first embodiment. Further, similarly to in the first embodiment, the heat-resistant ceramics can be placed at predetermined positions, as a matter of course.

With the present embodiment, it is possible to erase the arc generated at the time of opening and closing of the contact points through the magnetic force (Lorentz force) of the magnetic field generated from the permanent magnet 57 and, also, it is possible to lead dusts 110 induced by the occurrence of the arc to positions distant from the surfaces of the fixed contact points 55*a* and 56*a*, as illustrated in FIG. 18B. This reduces the possibility of adhesion of the dusts 110 to the surfaces of the contact points, thereby reducing the possibility of the occurrence of contact failures. Further, the number of components and the number of assembling processes can be reduced, which can increase the production efficiency and also can save the space, thereby offering the advantage of provision of an electromagnetic relay with a further reduced size.

INDUSTRIAL APPLICABILITY

One or more embodiments of the present invention can be also applied to other opening/closing devices such as switches, timers and the like, as well as electromagnetic relays for shutting off direct currents or for shutting off alternating currents as a matter of course.

The invention claimed is:

1. An electromagnetic relay comprising:

a movable iron core;

an insulation holder integrated with an upper end portion of the movable iron core;

a movable contact piece supported by the insulation holder; and a solenoid formed from a wound coil, wherein the movable iron core is housed in an axial hole in the solenoid movably in the upward and downward directions, wherein the movable iron core is adapted to be moved upwardly and downwardly based on magnetization and demagnetization of the solenoid for contacting and separating a movable contact point provided on the movable contact piece with and from a fixed contact point for opening and closing a contact point, wherein a permanent magnet is embedded in a base portion of the insulation holder, and wherein the insulation holder and a pull-out preventing concave and convex portion formed at the upper end portion of the movable iron core are integrally molded.

2. The electromagnetic relay according to claim 1, wherein an arc-erasing ceramic member is placed at least at a portion of the inner side surface of a housing which houses the fixed contact point and the movable contact point and also shields the arc generated at the time of opening and closing of the contact point.

* * * * *